US010750582B2

(12) United States Patent
Ginn et al.

(10) Patent No.: US 10,750,582 B2
(45) Date of Patent: Aug. 18, 2020

(54) ELECTRODE REMOVAL DEVICE AND VEHICLE POSITIONING SYSTEM AND METHOD OF USE

(71) Applicant: NUCOR STEEL GALLATIN, LLC, Ghent, KY (US)

(72) Inventors: Damon Trent Ginn, Bedford, KY (US); Clarence David Sullivan, Warsaw, KY (US)

(73) Assignee: NUCOR STEEL GALLATIN, LLC, Ghent, KY (US)

( * ) Notice: Subject to any disclaimer, the term of this patent is extended or adjusted under 35 U.S.C. 154(b) by 273 days.

(21) Appl. No.: 15/644,269

(22) Filed: Jul. 7, 2017

(65) Prior Publication Data

US 2018/0014367 A1 Jan. 11, 2018

Related U.S. Application Data

(60) Provisional application No. 62/360,044, filed on Jul. 8, 2016.

(51) Int. Cl.

| | |
|---|---|
| ***H05B 7/10*** | (2006.01) |
| ***B66F 9/12*** | (2006.01) |
| ***B66F 9/18*** | (2006.01) |

(52) U.S. Cl.

CPC ..... *H05B 7/10* (2013.01); *B66F 9/12* (2013.01); *B66F 9/18* (2013.01)

(58) Field of Classification Search

CPC ..... H05B 7/10; B66F 9/12; B66F 9/18; Y10T 29/49721

See application file for complete search history.

(56) References Cited

U.S. PATENT DOCUMENTS 3,559,816 A * 2/1971 Hirata ..... B66C 13/00 212/312

4,736,384 A * 4/1988 Sakai ..... H05B 7/14 373/92

* cited by examiner

*Primary Examiner* — Bayan Salone

(74) *Attorney, Agent, or Firm* — Moore & Van Allen, PLLC; Jeffrey R. Gray

(57) ABSTRACT

An electrode adjustment device and a vehicle positioning system for positioning the electrode adjustment device adjacent a furnace. The electrode adjustment device is utilized for adjusting the electrode during maintenance of the furnace (e.g., removal of the electrode for replacement or repair, repair of the refractory material, or other like furnace or electrode repair). When the electrode adjustment device is moved to a location adjacent the furnace, it is used to apply force under the bottom electrode to break the connection between the bottom electrode and the furnace. After the connection is broken the bottom electrode is pushed up into the furnace vessel by the electrode adjustment device until the electrode can be removed. After removing the bottom electrode, the electrode adjustment device is covered with debris and can be cleaned adjacent the furnace.

18 Claims, 19 Drawing Sheets

ELECTRODE REMOVAL DEVICE AND VEHICLE POSITIONING SYSTEM AND METHOD OF USE

CROSS REFERENCE AND PRIORITY CLAIM UNDER 35 U.S.C. § 119

The present application for a patent claims priority to U.S. Provisional Patent Application Ser. No. 62/360,044 entitled "ELECTRODE REMOVAL DEVICE AND VEHICLE POSITIONING SYSTEM AND METHOD OF USE" filed on Jul. 8, 2016 and assigned to the assignees hereof and hereby expressly incorporated by reference herein.

FIELD

The present invention is related to the field of electrode removal and replacement from furnaces.

BACKGROUND

In furnaces, such as steelmaking furnaces, electrodes or the portions of the furnace located adjacent the electrodes, become worn down, broken, or the like and require removal, repair, replacement, and/or the like. The process for removing and/or replacing electrodes, and in particular bottom electrodes, from a furnace typically includes utilizing devices and systems that can push the electrodes from below and an overhead crane that can lift the electrodes from above. However, due to the weight of the electrodes and the requirements for positioning and supporting the electrodes during removal and/or replacement, improvements to the devices and systems used to remove and/or replace the electrodes are needed.

SUMMARY OF THE EMBODIMENTS OF THE INVENTION

Embodiments of the present invention relate to an electrode adjustment device (e.g., otherwise described as an electrode removal device, an electrode push-up device, or the like) and a vehicle positioning system, as well as a process for positioning and using the electrode adjustment device. The electrode adjustment device is utilized for adjusting the electrode during maintenance of a furnace in which the electrode functions to provide heat to the contents of the furnace. Maintenance of a furnace may occur for a number of reasons, such as but not limited to, removal of the electrode for replacement or repair, repair of the refractory material in the furnace, or other like furnace or electrode repairs. Electrode adjustment devices are typically used in applications where a furnace has an electrode proximate the bottom of the furnace. The electrode adjustment device and method can, for example, be used advantageously in connection with furnaces used to melt steel, which may have one or more electrodes that extend inside the furnace from the bottom of the furnace.

When the electrode adjustment device is moved to a location adjacent (e.g., under, next two, and/or the like) the furnace, and force is applied to a bottom electrode, the connection between the bottom electrode and the furnace is broken (e.g., residual material such as steel that formed between the electrode and the furnace is broken). After the connection is broken, the bottom electrode is pushed up into the interior of the furnace by the electrode adjustment device until the electrode can be removed from the furnace, such as through the use of an overhead crane that is positioned above the open furnace and is operatively coupled to the electrode.

The vehicle positioning system is configured for operatively coupling with the electrode adjustment device in order to easily move the electrode adjustment device between storage and operation under the furnace, and to provide adjustment for allowing more exact locating of the electrode adjustment device to push and/or receive an electrode. The electrode adjustment device may weigh between 15 to 30 tons (or more or less depending on the application), and consequently the vehicle positioning system must support the weight, while also providing for fine adjustment to allow for correct and safe positioning of the electrode adjustment device. As such, not only will the vehicle positioning system be able to transport the electrode adjustment device, but will also be able to lift, rotate, angle, and/or move in multiple axes to position the electrode adjustment device as needed, as will be discussed in detail throughout this specification.

In addition to electrode removal, the electrode adjustment device and/or the vehicle positioning system may be utilized to receive an electrode from an overhead crane and position the electrode to reassemble the electrode with the furnace. After removing and/or replacing the bottom electrode, the electrode adjustment device and/or the vehicle positioning system are covered with debris (e.g., dust, material, or the like) that falls from the bottom of the furnace and/or from inside of the furnace where the electrode has been removed and/or replaced. The electrode adjustment device and/or the vehicle positioning system may be cleaned by a user in its location adjacent (e.g., under) the furnace before the electrode adjustment device is removed by the vehicle positioning system for storage.

It should be further understood that the vehicle positioning system may not only be able to transport the electrode adjustment device, but it may also be able to transport steel coils. As such, the vehicle positioning system may have dual functionality that allows the vehicle positioning system to operate more efficiently.

Embodiments of the invention comprise a vehicle positioning system for transporting an electrode adjustment device. The vehicle positioning system comprises a vehicle system, and a positioning system operatively coupled to the vehicle system. The positioning system comprises a lift system operatively coupled to a support system. The lift system comprises a lift frame having a first lift frame and a second lift frame, wherein the second lift frame is moveable with respect to the first lift frame. The lift system further comprises a lift drive operatively coupled to the first lift frame or the second lift frame for moving the second lift frame with respect to the first lift frame. The lift system also comprises one or more lift couplings, wherein the one or more lift couplings are configured for operatively coupling with the support system. Moreover, the support system is configured for operative coupling with the electrode adjustment device for positioning the electrode adjustment device for adjusting an electrode during removal or assembly with a furnace.

In further accord with embodiments of the invention, the vehicle positioning system further comprises the electrode adjustment device. The electrode adjustment device comprises an adjustment drive, an adjustment head operatively coupled to the adjustment drive, an adjustment base operatively coupled to the adjustment drive, and one or more electrode adjustment device couplings operatively coupled to the adjustment drive, the adjustment head, or the adjustment base.

In other embodiments of the invention the vehicle positioning system further comprises a support member operatively coupled to the lift system. The adjustment base comprises an aperture. Additionally, the support member is configured for entry and removal from the aperture of the adjustment base. The support system is configured to be removable from the lift system in order to allow for transport of steel coils.

In still other embodiments of the invention the support system comprises a support frame and one or more locking systems, wherein the one or more locking systems are configured for operative coupling with the electrode adjustment device. The support system further comprises one or more support couplings, wherein the one or more support couplings are configured for being operative coupling with the one or more lift couplings such that the support system may be removed and assembled.

In yet other embodiments of the invention the one or more support couplings comprise one or more upper support couplings, and one or more lower support couplings. The one more lift couplings comprise one or more upper lift couplings and one or more lower support couplings. The one or more upper support couplings are configured for operative coupling with the one or more upper lift couplings, and the one or more lower support couplings are configured for operative coupling with the one or more lower lift couplings.

In further accord with embodiments of the invention, the one or more locking systems comprise one or more locking couplings and one or more locking drives. Additionally, the electrode adjustment device comprises one or more electrode adjustment device couplings, and the one or more locking drives are configured for positioning the one or more locking couplings to assemble and disassemble the locking couplings with the one or more electrode adjustment device couplings to engage and disengage from the electrode adjustment device.

In other embodiments of the invention, the one or more locking couplings comprise one or more connectors and one or more connector drives operatively coupled to the one or more connectors. Moreover, the one or more electrode adjustment device couplings comprise an aperture, and the one or more connectors are configured for operative coupling with the one or more electrode adjustment device couplings through inserting a portion of the one or more connectors through the aperture of the one or more electrode adjustment device couplings and locking the one or more connectors with the aperture to prevent removal from the aperture.

In still other embodiments of the invention, the support system comprises one or more support members that are configured for operatively coupling with one or more electrode adjustment device couplings of the electrode adjustment device for positioning the electrode adjustment device for adjusting the electrode during removal or assembly with the furnace.

In yet other embodiments of the invention, wherein the one or more lift couplings comprise an upper lift coupling comprising at least a first upper lift coupling operatively coupled to the lift frame, and a second upper lift coupling operatively coupled to the lift frame, and a lower lift coupling. Additionally, the one or more support members comprise a first upper support member operatively coupled to the first upper lift coupling, a second upper support member operatively coupled to the second upper lift coupling, and a lower support member operatively coupled to the lower lift couplings. The first upper support member and the second upper support member are operatively coupled together and to the one or more electrode adjustment device couplings, and the lower support member is configured for operative coupling with one of the one or more couplings of the electrode adjustment device.

In further accord with embodiments of the invention, the vehicle system comprises a vehicle and a transverse drive operatively coupling the vehicle to the positioning system. The transverse drive is configured to move the positioning system a direction different from the lift drive of the lift system.

In other embodiments of the invention, the positioning system further comprises one or more vehicle couplings, and the vehicle is operatively coupled to the positioning system through the one or more vehicle couplings and the transverse drive.

In still other embodiments of the invention, the one or more vehicle couplings comprise at least one upper vehicle coupling operatively coupling the vehicle to the positioning system through the transverse drive, and a lower vehicle coupling operatively coupling the vehicle to the positioning system through a rotational connection. The transverse drive rotates the positioning system around the lower vehicle couplings.

Embodiments of the invention further comprise an electrode adjustment device. The electrode adjustment device comprises an adjustment drive, an adjustment head operatively coupled to the adjustment drive, and one or more electrode adjustment device couplings operatively coupled to the adjustment drive or the adjustment head. The one or more electrode adjustment device couplings are configured for operative coupling with a vehicle positioning system that is configured to lift the electrode adjustment device for positioning under a furnace. The adjustment drive is configured to move the adjustment head to aid in removing or assembling an electrode from or with the furnace.

In further accord with embodiments of the invention, the electrode adjustment device further comprises an adjustment base operatively coupled to the adjustment device. The one of the one or more electrode adjustment device couplings comprise a lower electrode adjustment device coupling operatively coupled to the adjustment base. The lower electrode adjustment device coupling is an aperture in the adjustment base configured to receive a lower support member from the vehicle positioning system.

Embodiments of the invention comprise a method for removing an electrode within a furnace utilizing an electrode adjustment device and a vehicle positioning system. The method comprises utilizing a vehicle positioning system to operatively couple the vehicle positioning system with the electrode adjustment device. The vehicle positioning system comprises a vehicle system and a positioning system operatively coupled to the vehicle system. The positioning system comprises a lift system and a support system comprising one or more support couplings that are used to operatively coupled the support system to the lift system. The lift system comprises a first lift frame and a second lift frame, and the second lift frame is moveable with respect to the first lift frame. The lift system further comprises a lift drive operatively coupled to the first lift frame or the second lift frame for moving the second lift frame with respect to the first lift frame. The electrode adjustment device comprises an adjustment drive, an adjustment head operatively coupled to the adjustment drive, and one or more electrode adjustment device couplings operatively coupled to the adjustment drive or the adjustment head. The one or more support couplings are operatively coupled to the one or more electrode adjustment device couplings, and the adjustment drive is configured to adjust the electrode using the adjustment head to aid in removing the electrode from the furnace.

In further accord with embodiments of the invention, the method comprises transporting the electrode adjustment device to adjacent an electrode in a furnace using the vehicle positioning system, disengaging the vehicle positioning system from the electrode removal device, and adjusting the electrode in the furnace by separating the electrode from the furnace using the electrode adjustment device.

In other embodiments of the invention, the method further comprises transporting the electrode adjustment device away from the furnace using the vehicle positioning system, and disengaging the vehicle positioning system from the electrode removal device.

In still other embodiments of the invention, utilizing the vehicle positioning system to operatively couple the vehicle positioning system with the electrode adjustment device comprises extending a locking system to a raised position. Thereafter, the locking system is moved for coupling with one or more electrode adjustment couplings of the electrode adjustment device by moving at least a portion of the positioning system or by moving the vehicle positioning system. Thereafter locking occurs by retracting the locking system to a locked position.

In yet other embodiments of the invention, the electrode adjustment device further comprises an adjustment base operatively coupled to the adjustment device, and one of the one or more electrode adjustment device couplings comprise a lower adjustment device coupling within the base. The lower adjustment device is configured to receive a lower support member of the positioning system.

In further accord with embodiments of the invention, the vehicle positioning system further comprises a transverse drive and one or more vehicle couplings operatively coupling the positioning system to the transverse drive. The one or more vehicle couplings comprise an upper vehicle coupling operatively coupling the vehicle to the positioning system through the transverse drive, and a lower vehicle coupling operatively coupling the vehicle to the positioning system through a rotational connection. The transverse drive rotates the positioning system around the lower vehicle coupling.

To the accomplishment of the foregoing and the related ends, the one or more embodiments of the invention comprise the features hereinafter fully described and particularly pointed out in the claims. The following description and the annexed drawings set forth certain illustrative features of the one or more embodiments. These features are indicative, however, of but a few of the various ways in which the principles of various embodiments may be employed, and this description is intended to include all such embodiments and their equivalents.

BRIEF DESCRIPTION OF THE SEVERAL VIEWS OF THE DRAWINGS

The accompanying drawings illustrate embodiments of the present disclosure, in which.

BRIEF DESCRIPTION

Embodiments of the present invention will now be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

Figure 1:
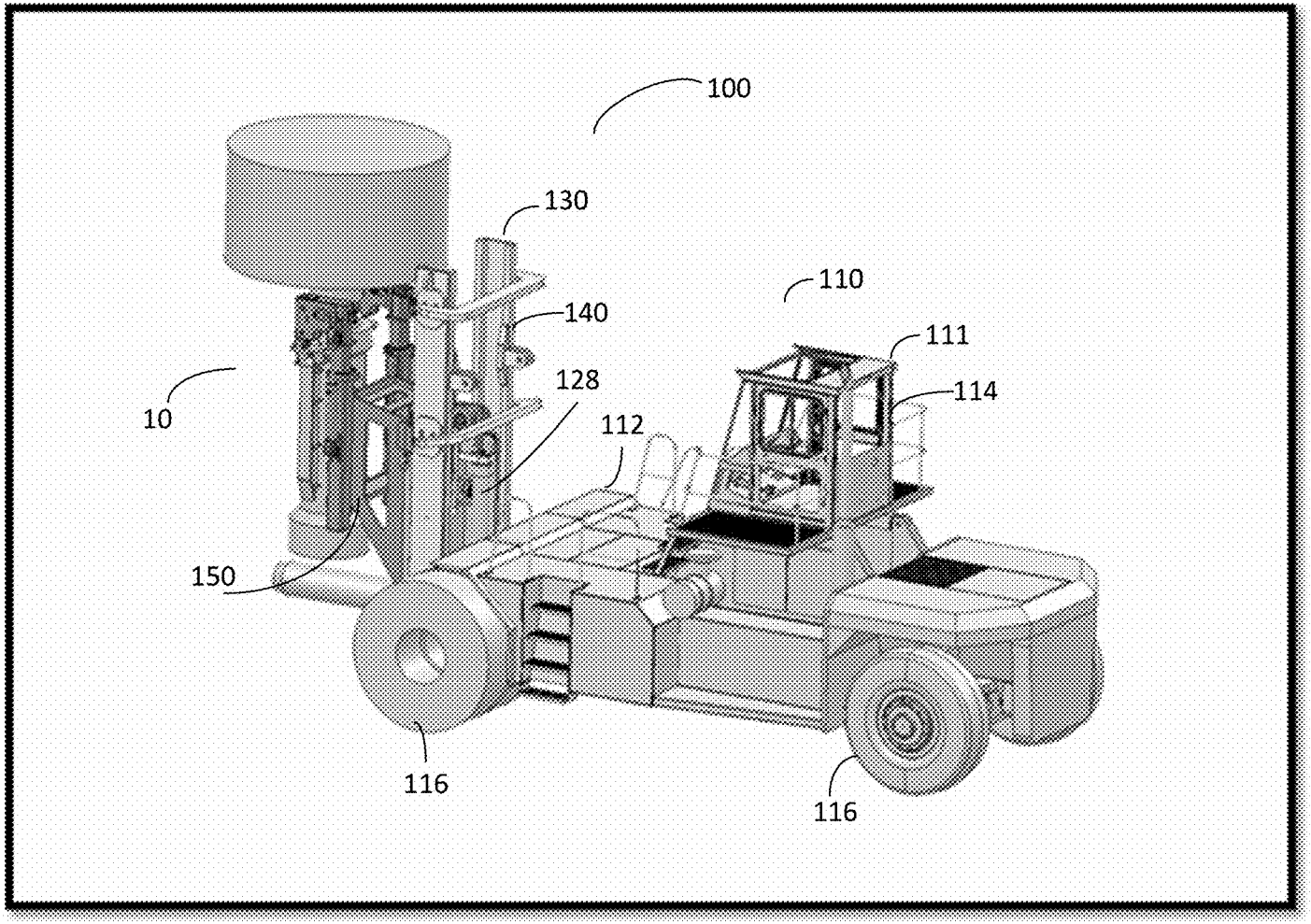
FIG. 1 illustrates a perspective view of the electrode adjustment device and vehicle positioning system, in accordance with embodiments of the invention.
Figure 2:
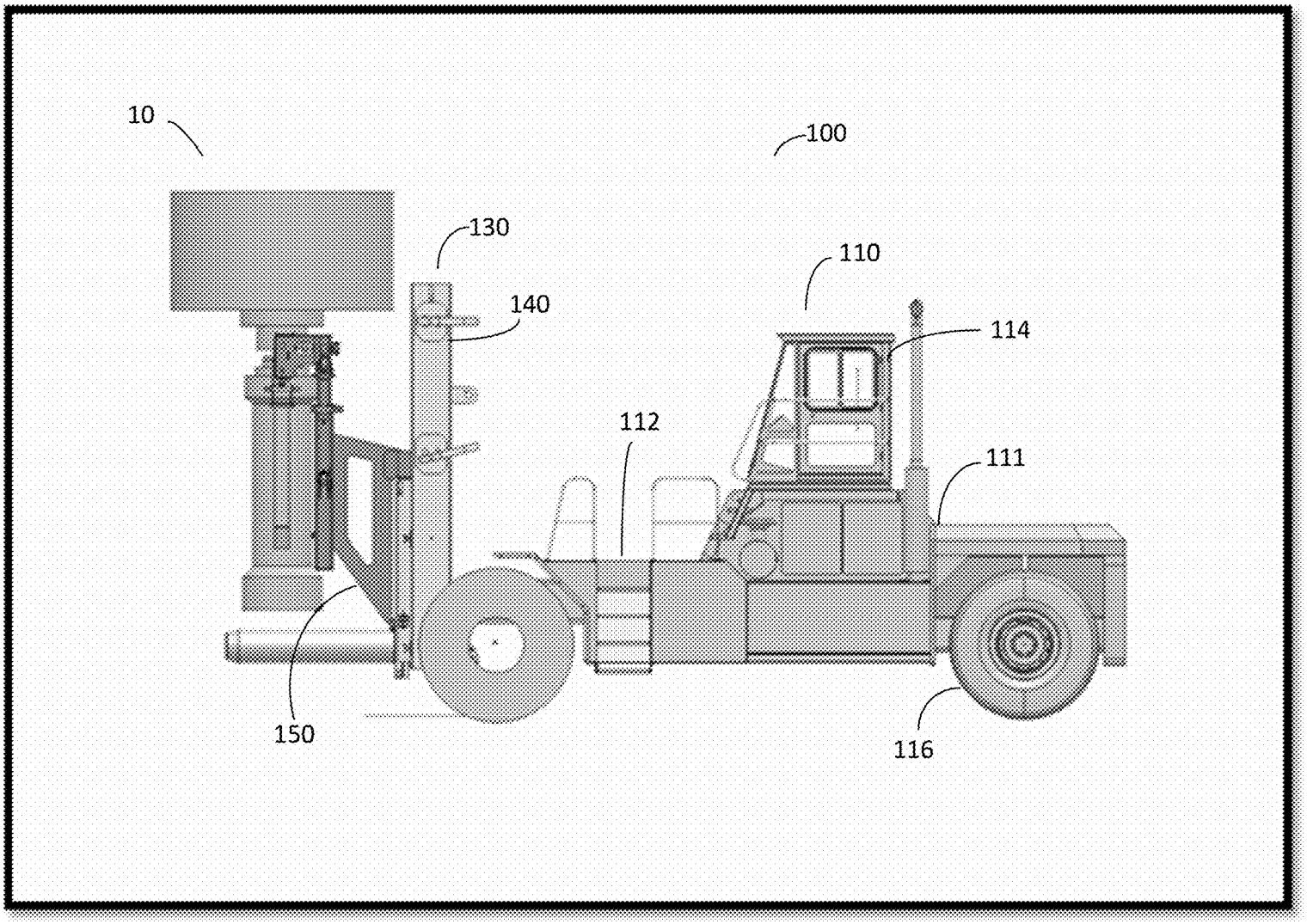
FIG. 2 illustrates a side view of the electrode adjustment device and the vehicle positioning system, in accordance with embodiments of the invention.

The present invention relates to a portable electrode adjustment device 10 (e.g., an electrode removal device, a push-up electrode device, or the like) and a vehicle positioning system 100, that is used to position the electrode adjustment device 10 for operation. As illustrated in FIGS. 1 and 2 the positioning system 100 may comprise a vehicle positioning system 110 that is capable of lifting the electrode adjustment device 10 in order to position it under the furnace when needed for electrode removal (otherwise described as disassembly) and/or replacement (otherwise described as assembly). The vehicle positioning system comprises a vehicle 111, which may be a specialized vehicle specifically designed for use with the electrode adjustment device 10, or in other embodiments, the vehicle 111 may be a coil transport vehicle, which is typically used to transfer coils of steel sheets throughout a steel facility. As such, in some embodiments of the invention, the vehicle positioning system 100 may be able to operate as both an electrode adjustment device and a coil transport (e.g., by removing the positioning system 130, or a portion thereof such as the support system 150, or the like). In some embodiments the vehicle positioning system 100 may comprise a vehicle system 110 and a positioning system 130. The positioning system 130 may comprise a lift system 140 and a support system 150. The lift system 140 is used to move the support system 150 into the desired position. The support system 150 is used to support the electrode adjustment device 10 for disassembly and assembly in a furnace.

As illustrated in FIGS. 3-6, the electrode adjustment device 10 comprises a first adjustment device end 12 and a second adjustment device end 14. The first adjustment device end 12 is the end that is used to adjust (e.g., push-up or receive and slowly drop) an electrode, such as a bottom electrode of a furnace. The second adjustment device end 14 is the end that is placed on a foundation (e.g., a support floor, or other support, which supports the electrode adjustment device 10 for adjusting the electrode). During processing of steel within a steelmaking furnace, the bottom electrode, refractory, steel by-products, hardened steel, or the like may become coupled together such that force is required to separate the electrode from the furnace. During electrode disassembly (e.g., removal), the electrode adjustment device 10 pushes off the foundation at the second end 14 while the first end 12 pushes against the electrode in order to dislodge the electrode from the furnace. During electrode assembly (e.g., replacement), the first end 12 receives the electrode and the second end 14 is supported by the foundation while the electrode adjustment device 10 slowly lowers the electrode into place.

Figure 3:
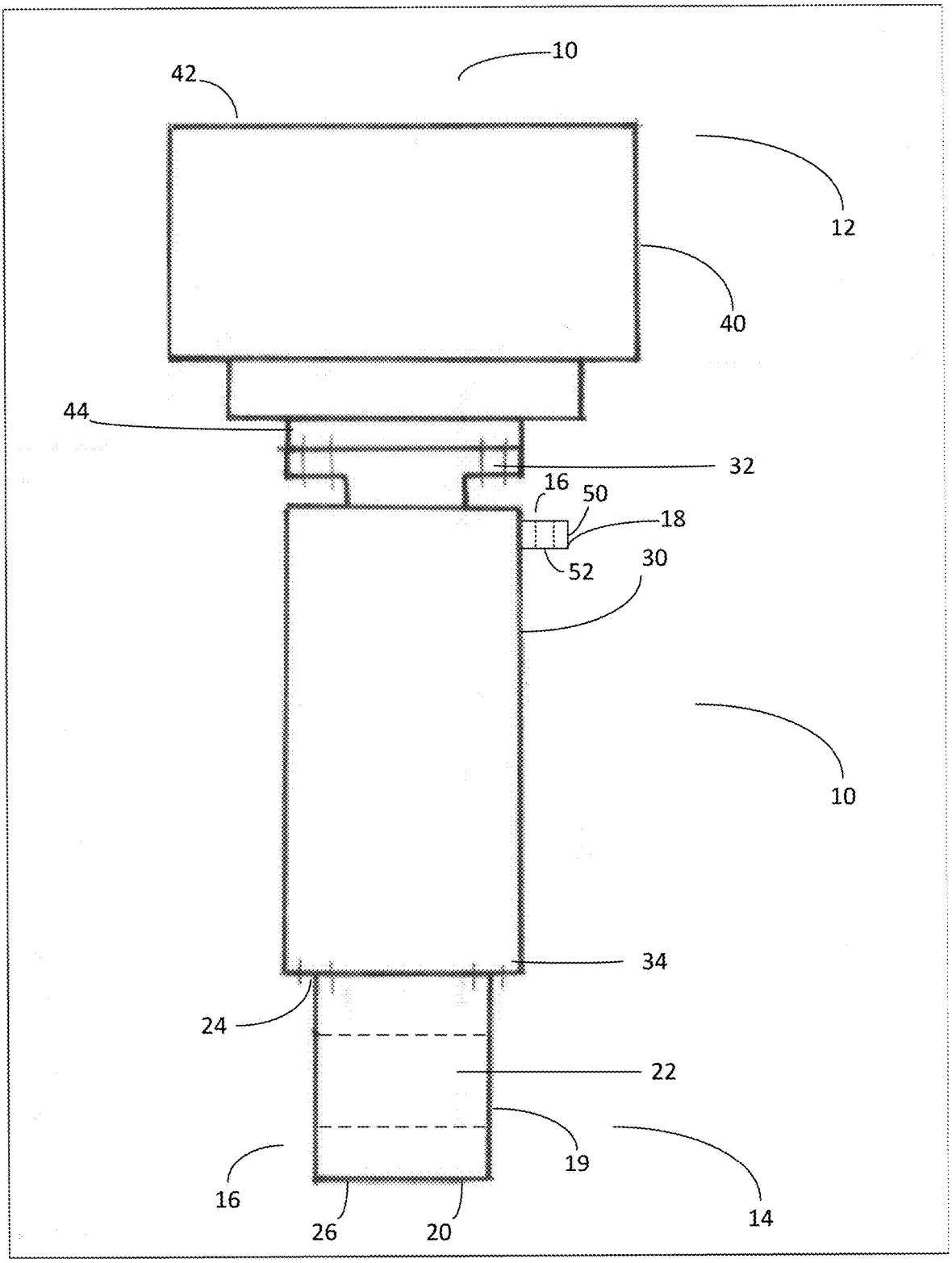
FIG. 3 illustrates a side view of an electrode adjustment device, in accordance with embodiments of the invention.
Figure 4:
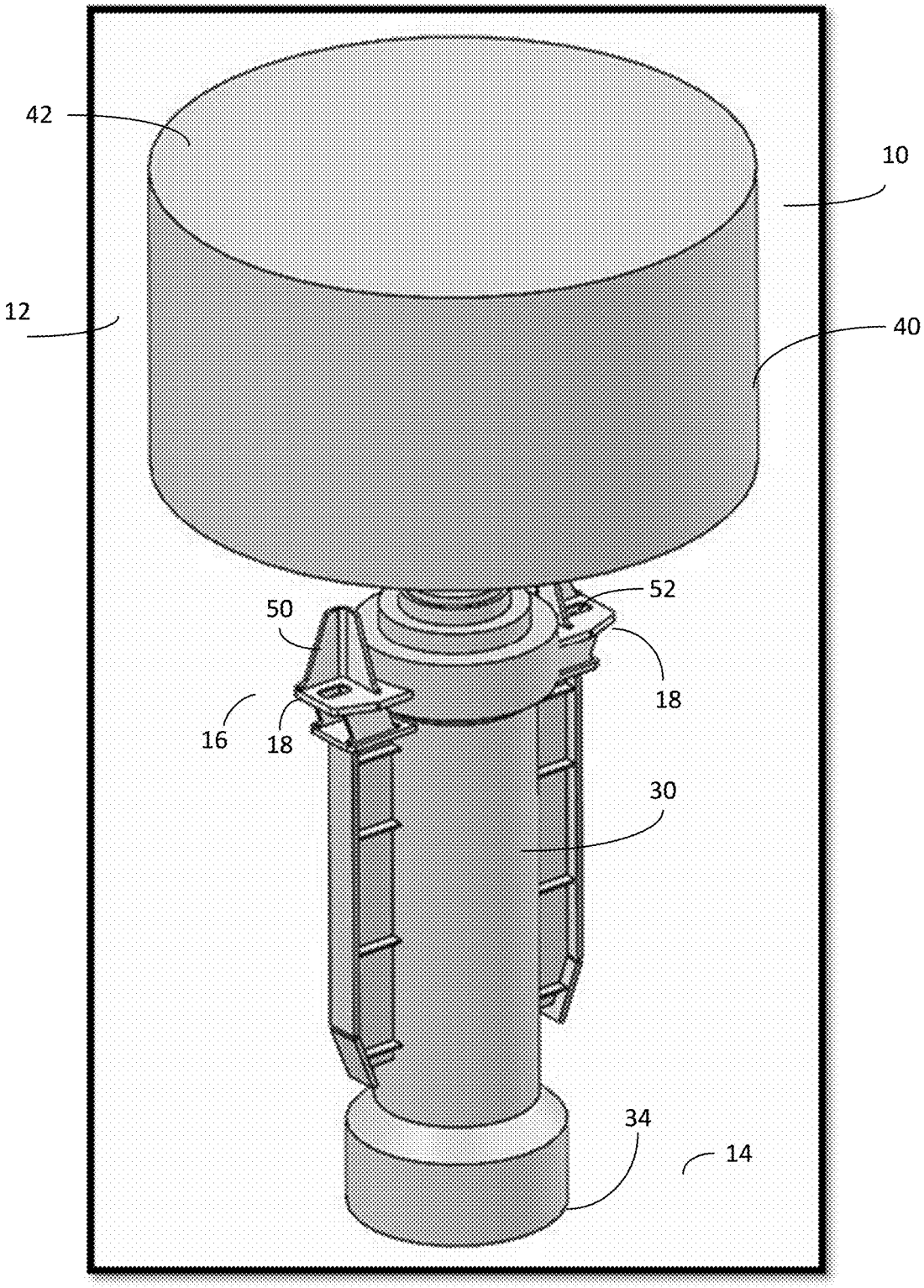
FIG. 4 illustrates a perspective view of the electrode adjustment device, in accordance with embodiments of the invention.
Figure 5:
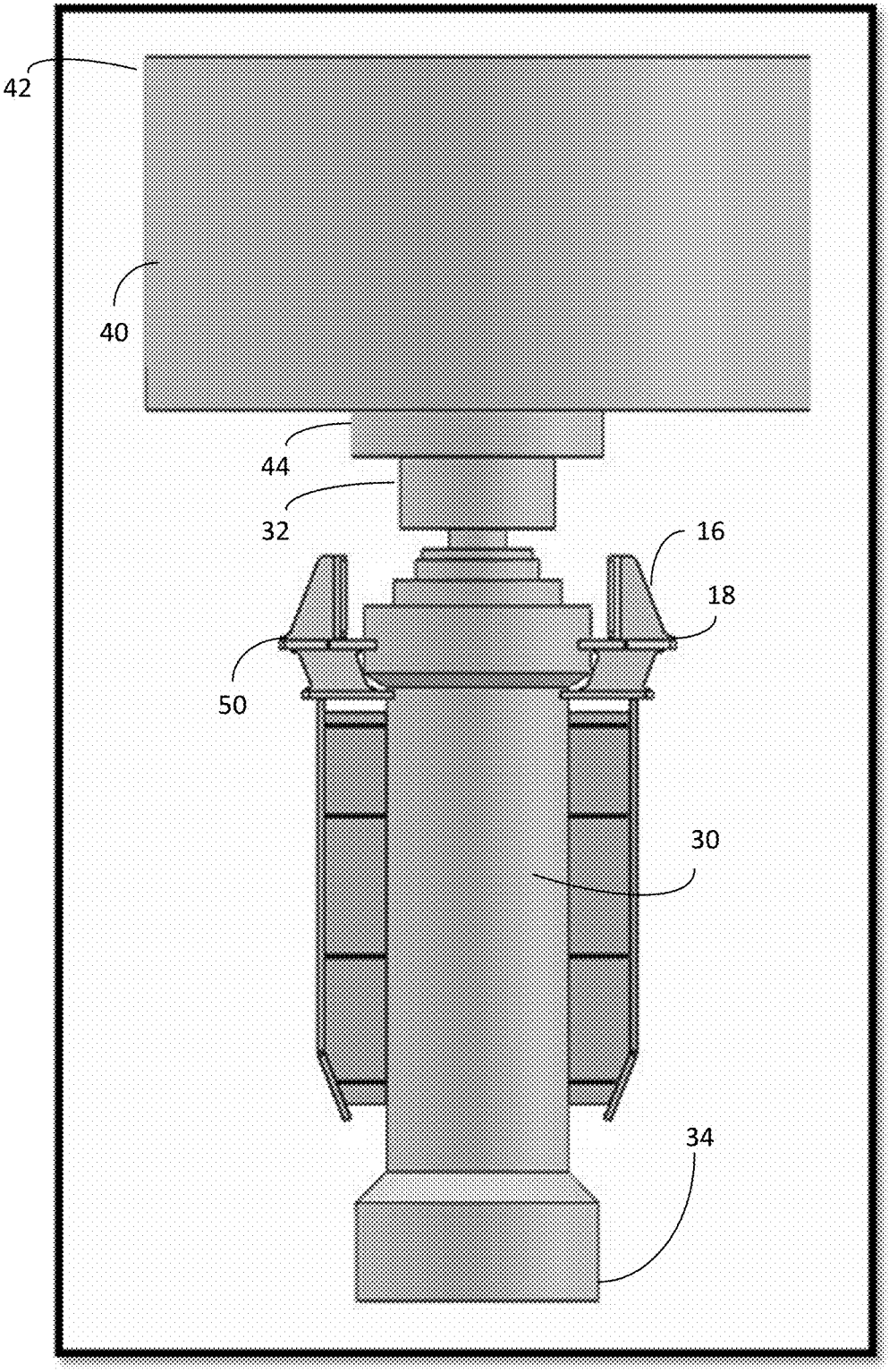
FIG. 5 illustrates a side view of the electrode adjustment device, in accordance with embodiments of the invention.
Figure 6:
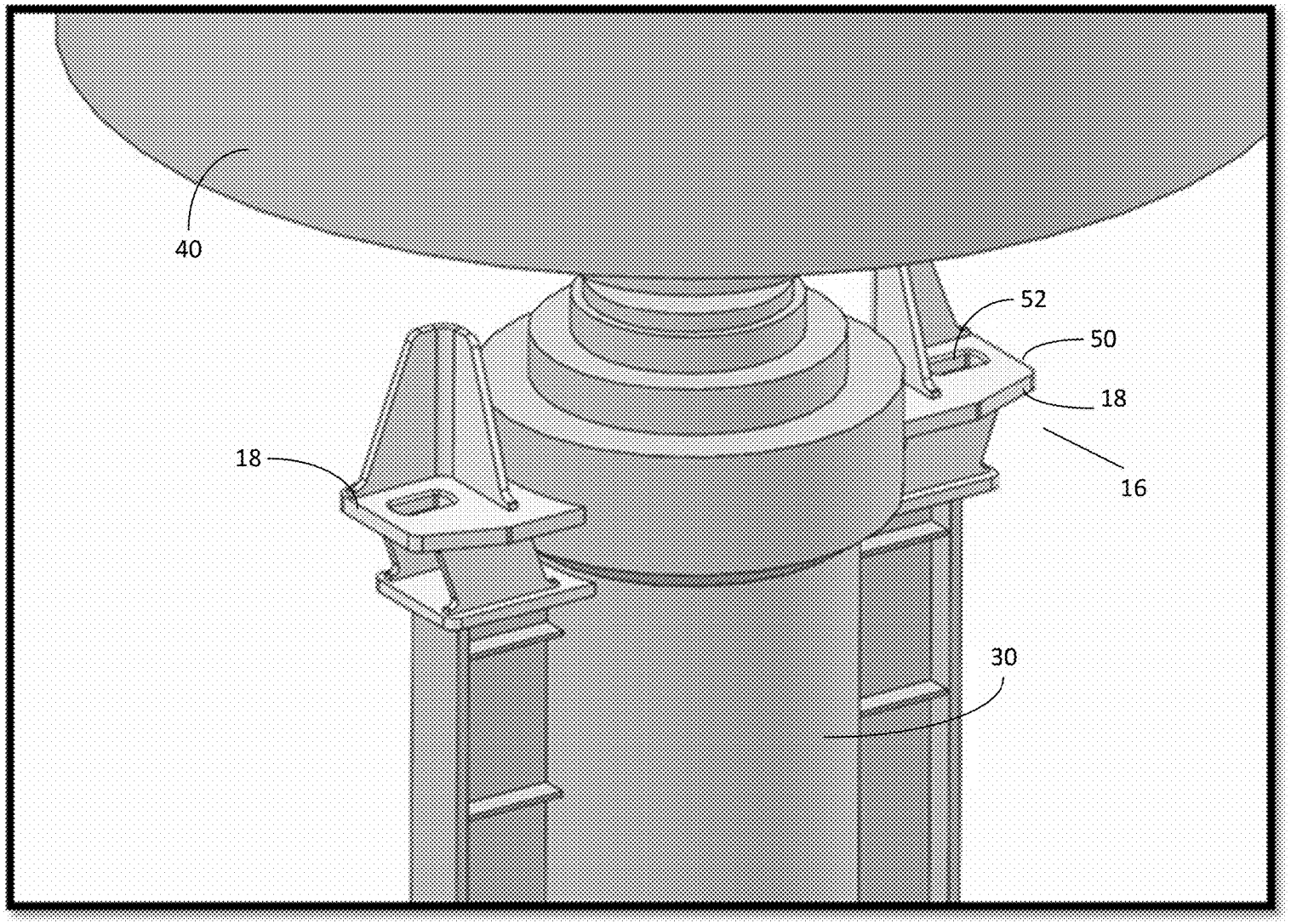
FIG. 6 illustrates a close up perspective view of the electrode adjustment device, in accordance with embodiments of the invention.

The vehicle positioning system 100 may be operatively coupled to the electrode adjustment device 10 in a number of ways to position the electrode adjustment device 10, as needed. In some embodiments of the invention, as illustrated in FIG. 3, the electrode adjustment device 10 may comprise an adjustment base 20, an adjustment drive 30, and an adjustment head 40. The adjustment base 20 may be used to push off of the foundation. Moreover, the adjustment base 20 is operatively coupled to the adjustment drive 30, which may be a type of actuator, such as a hydraulic cylinder, or other like drive, which is used to allow controlled movement (e.g., adjustment) of the electrode during disassembly or assembly with the furnace. The adjustment drive 30 may be operatively coupled to an adjustment head 40, which is operatively coupled with (e.g., contacts, or the like) an electrode when the electrode is being removed from or assembled within the furnace. It should be understood that the adjustment base 20, the adjustment drive 30, and/or the adjustment head 40 may be separate components that are removeably operatively coupled, or may be permanently operatively coupled together.

The electrode adjustment device 10 may have one or more adjustment device couplings 16, which are used for operative coupling with the vehicle positioning system 100 to allow the electrode adjustment device 10 to be positioned in desired positions. The one or more adjustment device couplings 16 may be operatively coupled to the electrode positioning device 10 at any location on the device 10. However, in some embodiments of the invention, the one or more adjustment device couplings 16 may include at least an upper adjustment device coupling 18 (e.g., two upper couplings), which may be located anywhere on the electrode adjustment device 10, such as anywhere on the adjustment drive 30 and/or the adjustment head 40. Moreover, in other embodiments of the invention, the one or more adjustment device couplings 16 may include at least a lower adjustment device coupling 19, which may be located on and/or in the adjustment base 20. For example, the two or more adjustment device upper couplings 18 may be located on the adjustment head 40 or the adjustment drive 30, and the lower adjustment device coupling 19 may be located on the adjustment base 20. In some embodiments of the invention the upper coupling 18 may be located on the adjustment drive 30, and the lower adjustment device coupling 19 may be located within the adjustment base 20.

The one or more adjustment couplings 16, and in particular the one or more adjustment device couplings 18 may comprise a coupling plate 50 (e.g., a tab, twist plate, or the like) with an aperture 52 (e.g., slot, hole, or the like) therein. In some embodiments, one or more coupling plates 50 may be used having one or more apertures 52. In one embodiment, the coupling plate 50 may extend around at least a portion of the electrode adjustment device 10 (or entirely around the device), and have at least two apertures 52, through which one or more locking systems 170, which are described in further detail later, may be used to couple the vehicle positioning system 100 to the electrode adjustment device 10.

As illustrated in FIG. 3, the adjustment base 20 of the electrode adjustment device 10 may have an adjustment base first end 24 that is operatively coupled to the adjustment drive second end 34. In some embodiments of the invention the adjustment base first end 24 and the adjustment drive second end 34 are operatively coupled through fasteners, while in other embodiments of the invention they are coupled through clamps or other like couplings. In some embodiments the adjustment base first end 24 and the adjustment drive second end 34 are integral with each other. The adjustment base portion 20 may have an adjustment base second end 26 that is configured for operative coupling with a foundation (e.g., a floor of a facility, or a support member operatively coupled to a floor of a facility). The adjustment base portion 20 may be used by the adjustment drive 30 as a bearing surface against which to push in order to push-up the electrode during disassembly from the furnace, and/or to support the electrode during re-assembly with the furnace.

As illustrated in FIGS. 3-6, the adjustment drive 30 may include an adjustment drive first end 32 and an adjustment drive second end 34. The adjustment drive first end 32 is operatively coupled to the adjustment head 40. In some embodiments of the invention the adjustment drive first end 32 and the adjustment head second end 44 are operatively coupled through fasteners, while in other embodiments of the invention they are operatively coupled through clamps or other like couplings. In other embodiments, the adjustment drive first end 32 and the adjustment head second end 44 may be integral with each other. The adjustment drive second end 34 is operatively coupled to the adjustment base first end 24 as previously discussed. The adjustment drive 30 may be utilized to adjust the position of the electrode by bearing on the adjustment base 20 and pushing the adjustment head 40 into the electrode to free the electrode from the furnace and/or support the electrode as the electrode is being reassembled to the furnace, as will be discussed with respect to the method illustrated in FIG. 19. The adjustment drive 30 moves the adjustment head 40 in some embodiments through the use of an actuator (e.g., a hydraulic, pneumatic, or other like actuator) that has enough power to support and move the electrode during assembly and disassembly.

The adjustment head 40 may include an adjustment head first end 42 and an adjustment head second end 44. The adjustment head first end 42 is operatively coupled to a portion of the electrode (e.g., the base of the bottom electrode, or the like) in order to push the bottom electrode from the furnace. By pushing the electrode, the electrode adjustment device 10 dislodges the electrode from the furnace (e.g., the electrode is broken free from furnace materials, such as hardened steel, or other by-products that have formed around the area of the interface between the electrode and the furnace). For example, the head first end 42 may align with the perimeter of the bottom electrode. The adjustment head 40 and/or other components, such as the adjustment derive 30 and the adjustment base 20, may include structural support members. The top surface is shaped in order to engage with the electrode. The adjustment head second end 44 is operatively coupled to the adjustment drive first end 32 as previously described. The adjustment head 40 is moved by the adjustment drive 30 in order to adjust the electrode (e.g., free the electrode from the furnace and/or support the electrode as the electrode is being reassembled to the furnace), as will be discussed with respect to FIG. 19.

Regardless of the configuration of the electrode adjustment device 10, it may be positioned using the vehicle positioning system 100. As previously described the vehicle positioning system 100 has a vehicle system 110 and a positioning system 130. As illustrated in FIGS. 1 and 2, the vehicle system 110 comprises a vehicle 111 having a vehicle frame 112, a cab 114, and transport 116 components. The vehicle frame 112 is utilized to support the cab 114 and is operatively coupled to the transport components 116 to allow the vehicle frame 112 and cab 114 to be mobile. The vehicle positioning system 100 is controlled by a user who operates it by steering and controlling the vehicle system 110 and the positioning system 130. In other embodiments of the invention, the vehicle positioning system 100 may be an automated system that can be controlled by a user located apart from the vehicle system 110, or may be an automated system that can be controlled by software, and/or may be controlled in another way. The vehicle system 110 may further comprise vehicle transport components 116, such as wheels, tracks, a rail system, or the like to allow the vehicle positioning system 100 to be moved into various positions and to transport the electrode adjustment device 10. The coupling of the vehicle system 110 with the positioning system 130 will be described in further detail with respect to FIG. 17.

Figure 7:
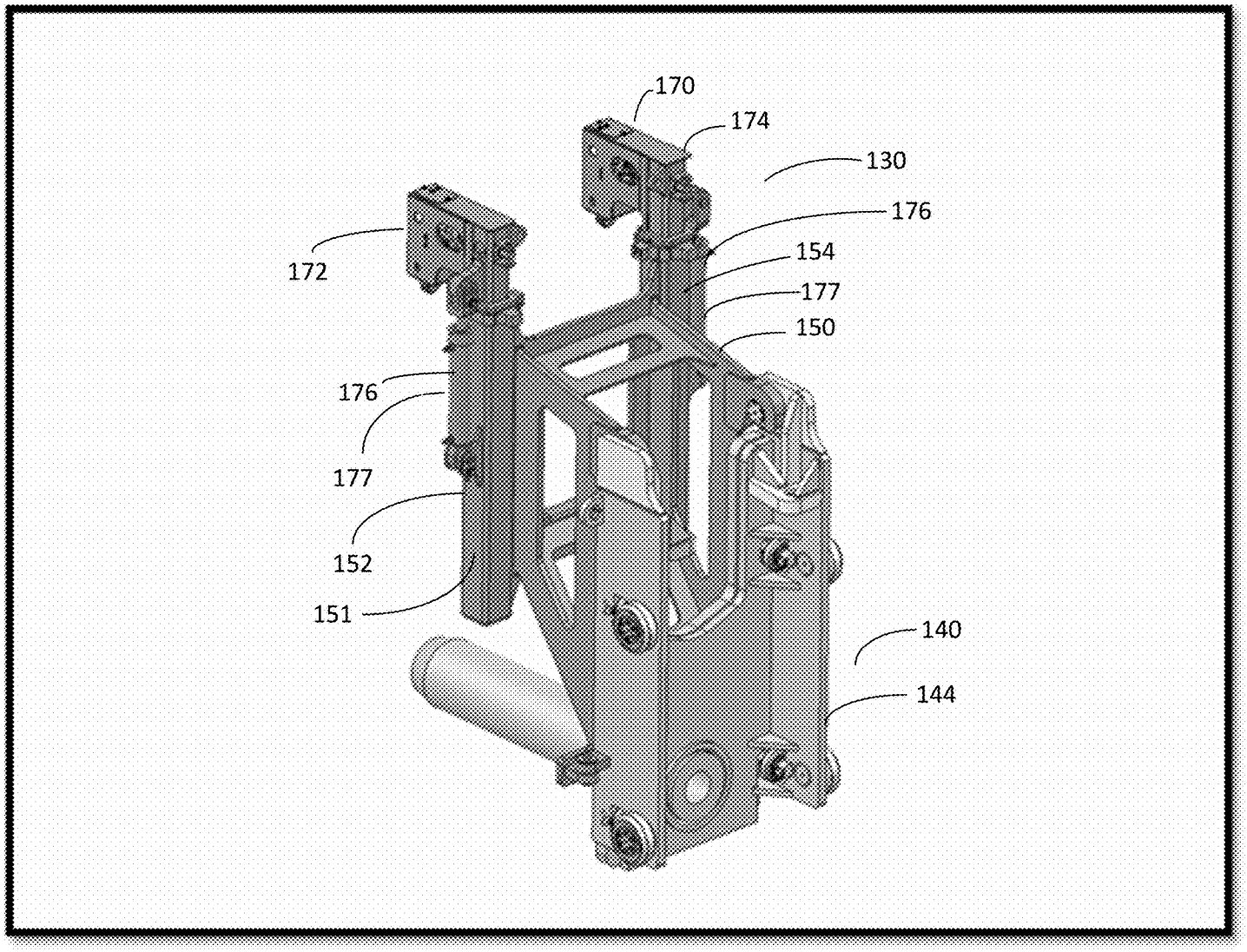
FIG. 7 illustrates a perspective view of a positioning system of the vehicle positioning system, in accordance with embodiments of the invention.
Figure 8:
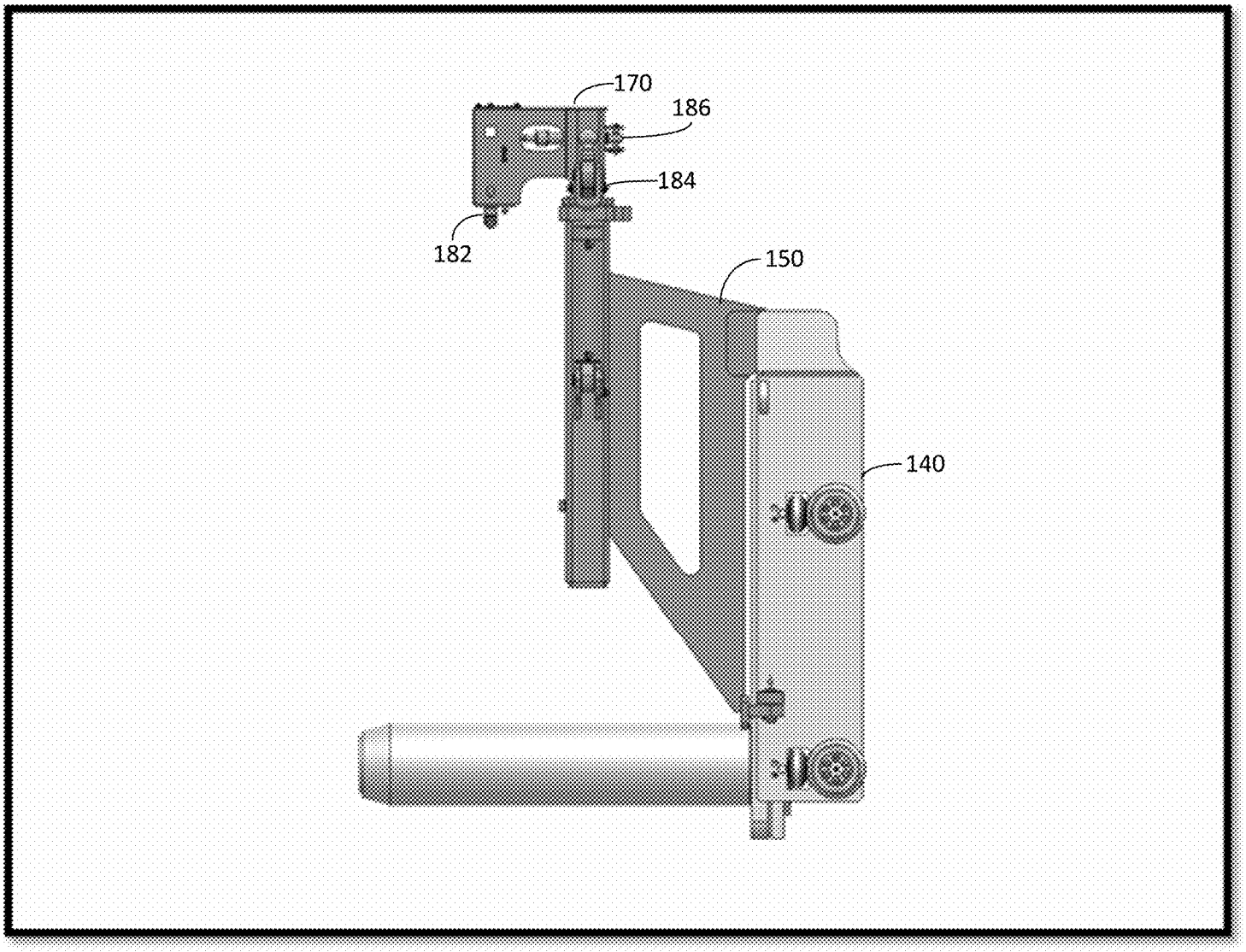
FIG. 8 illustrates a side view of the positioning system of the vehicle positioning system, in accordance with embodiments of the invention.
Figure 11:
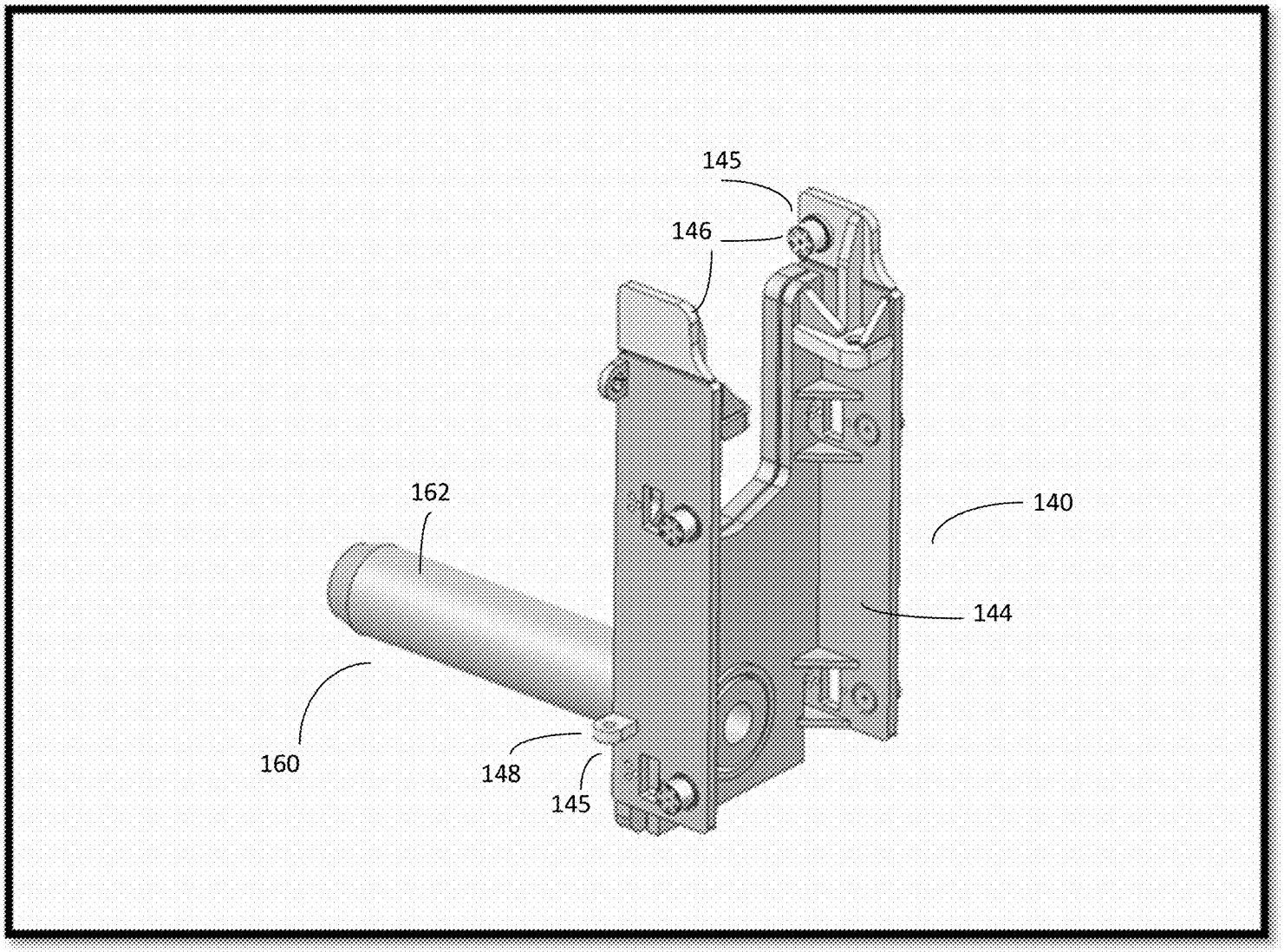
FIG. 11 illustrates a perspective view of a portion of a lift system of the positioning system, in accordance with embodiments of the invention.
Figure 12:
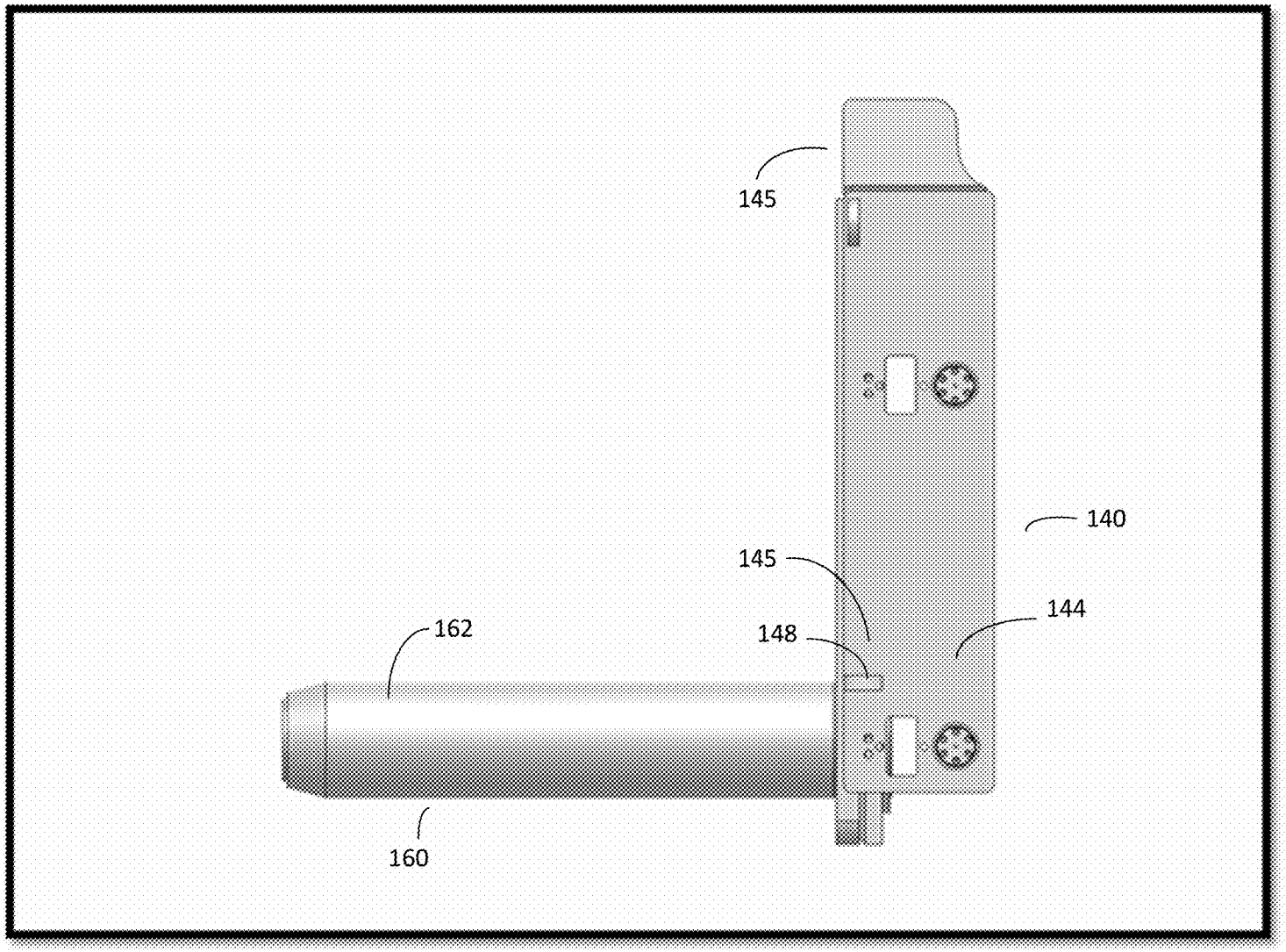
FIG. 12 illustrates a side view of a portion of a lift system of the positioning system, in accordance with embodiments of the invention.

The positioning system 130 of the vehicle positioning system 100 may comprise a lift system 140 with a support system 150, as illustrated in FIGS. 7 and 8. In some embodiments of the invention the lift system 140 comprises a first lift frame 142 (e.g., a stationary frame, or the like) and a second lift frame 144 (e.g., a moveable frame, or the like). In some embodiments of the invention the second lift frame 144 (and thus, the support system 150 coupled to the second lift frame 144) may be moveable with respect to the first lift frame 142 through the use of the lift drive 128. As such, the lift drive 128 may be operatively coupled to the first lift frame 142 and the second lift frame 144, and may allow the second lift frame 144 to be positioned with respect to the first lift frame 142, such as sliding within, outside of, or like with respect to each other. As illustrated in FIGS. 11 and 12, the lift system 140 may further comprise one or more lift couplings 145, such as one or more upper lift couplings 146 (e.g., operatively coupled to the second lift frame 144) and one or more lower lift couplings 148 (e.g., operatively coupled to the second lift frame 144) that are utilized for operative coupling with the support system 150. The one or more upper lift couplings 146 may be operatively coupled to one or more upper support couplings 158, and one or more lower lift couplings 148 may be operatively coupled to one or more lower support couplings 159.

Figure 9:
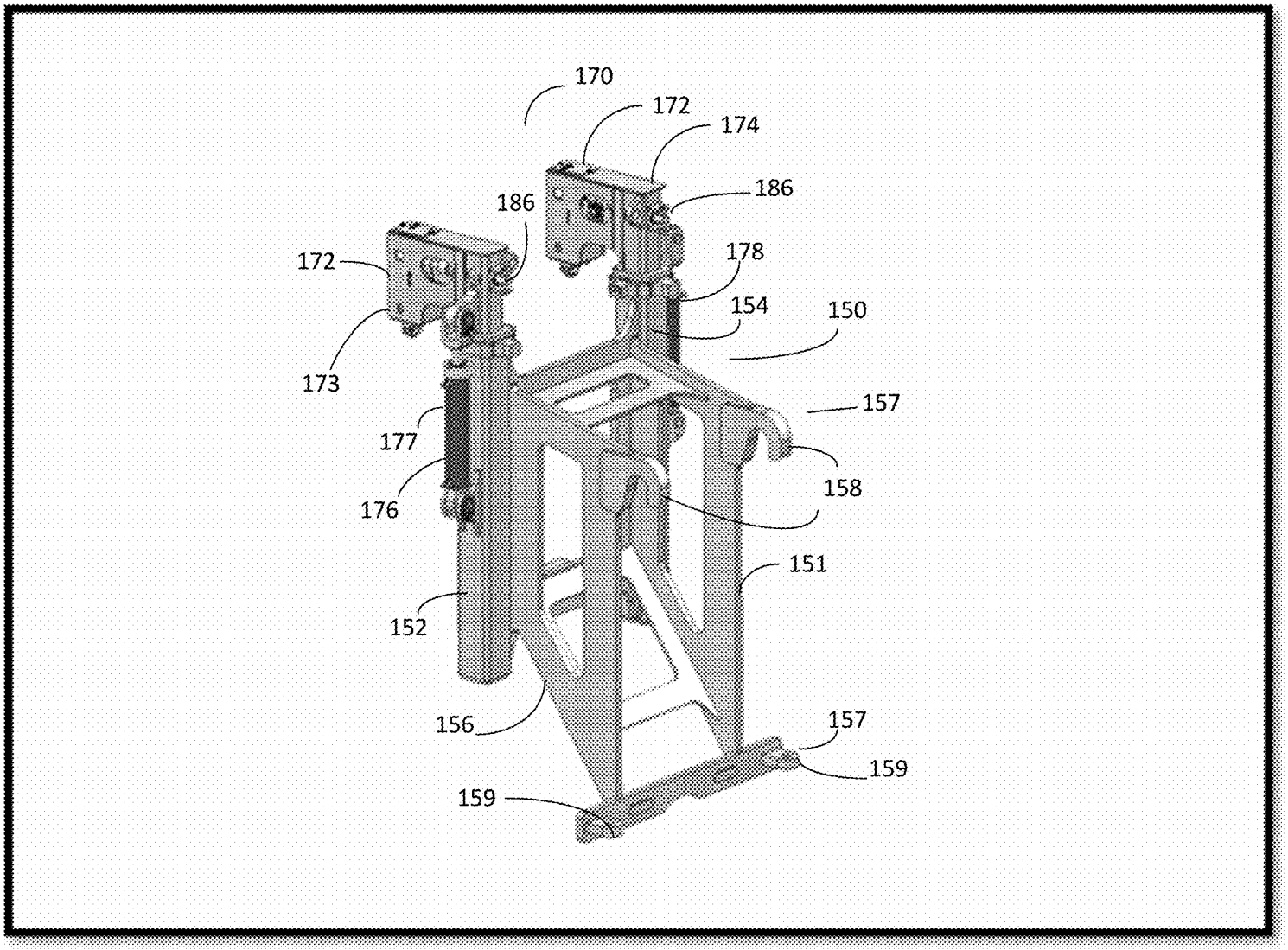
FIG. 9 illustrates a rear perspective view of a support system of the positioning system, in accordance with embodiments of the invention.
Figure 10:
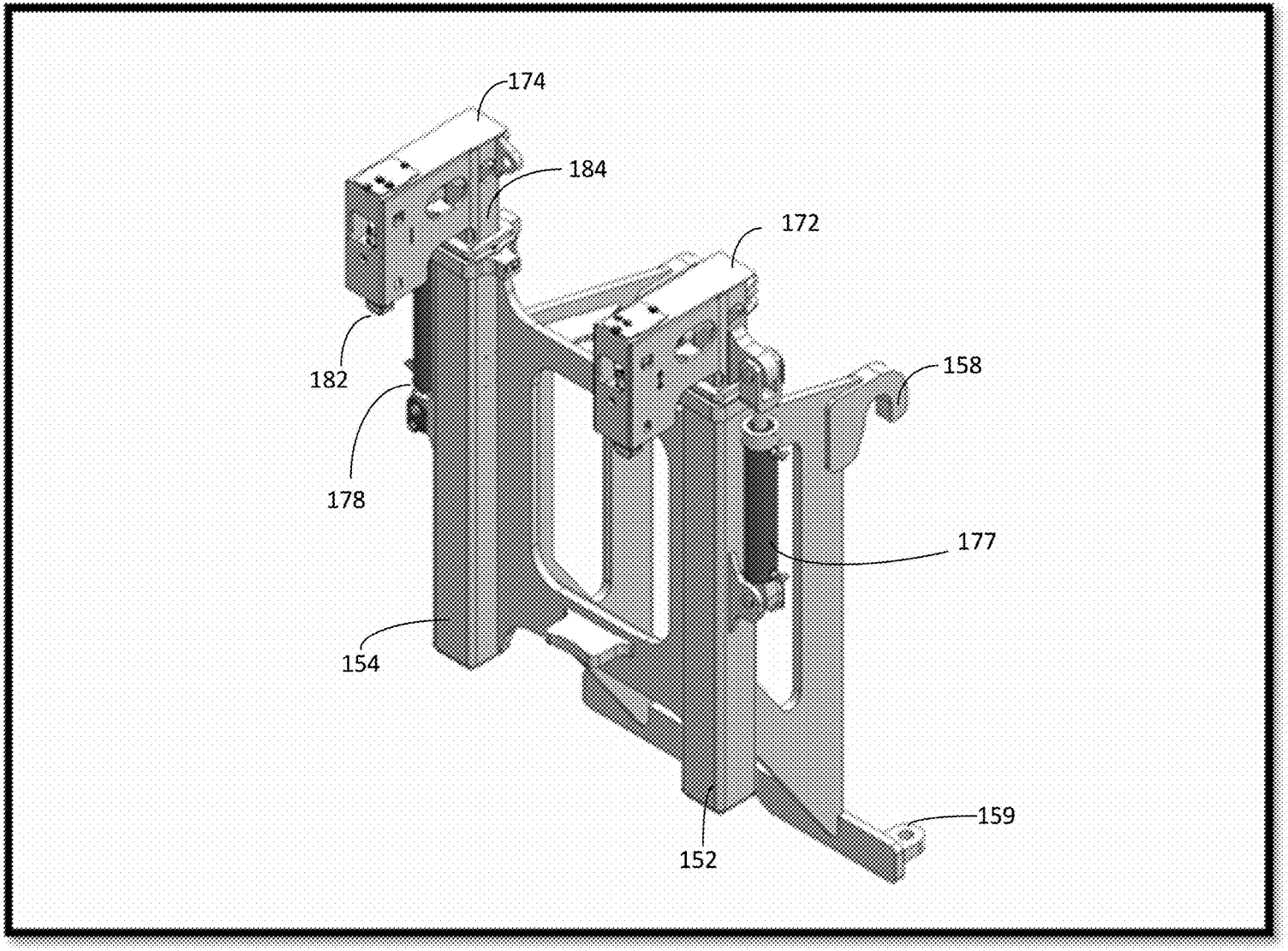
FIG. 10 illustrates a front perspective view of a support system of the positioning system, in accordance with embodiments of the invention.

As illustrated in FIGS. 9 and 10, the support system 150 may comprise a support frame including one or more upper support members 151 (e.g., a first upper support member 152 and a second upper support member 154, or other like support members) utilized to support the electrode adjustment device 10, as will be discussed in further detail later. The support frame 156 may also be operatively coupled to the lift system 140 through the use of one or more support couplings 157, as previously discussed. The one or more support couplings 157 may comprise upper support couplings 158 (e.g., hooks, or the like) and lower support couplings 159 (e.g., pin tabs, or the like).

It should be understood that in some embodiments, as illustrated in FIGS. 7-10, the support system 150 (e.g., the one or more upper support members 151) may comprise or be operatively coupled to a locking systems 170. The locking system 170 may comprise one or more locking couplings 172 and one or more locking drives 176. The one or more locking couplings 172 be operatively coupled to the support system 150 (e.g., the support frame 156 and/or the one or more support members 151), and/or the one or more locking drives 176. The one or more locking drives 176 may also be operatively coupled to the support system 150 (e.g., the support frame 156 and/or the one or more support members 151). In one embodiments of the invention, the one or more locking couplings 172 may comprise a first locking coupling 173 and a second locking coupling 174, and the one or more locking drives 176 comprise a first locking drive 177 and a second locking drive 178. As illustrated in the example in the figures, the first locking coupling 173 is operatively coupled to the both the first locking drive 177 and the first support member 152 and the second locking coupling 174 is operatively coupled to both the second locking drive 178 and the second support member 154. Moreover, the first locking drive 177 and the second locking drive 178 are also operatively coupled to the first support member 152 and the second support member 154, respectively. As such, the one or more locking drives 176 (e.g., the first locking drive 177 and/or the second locking drive 178) may extend and retract the one or more locking couplings 172 (e.g., the first locking coupling 173 and the second locking coupling 174), for example, into a lowered, raised, and locking position.

In some embodiments it should be understood that the one or more locking couplings 172 may each comprise a connector 182 (e.g., a twist lock, or the like) operatively coupled to a locking member 184 and a connector drive 186. The locking member 184 may be operatively coupled to a support member 151 (e.g., a first support member 152, a second support member 154, or the like), such as by inserting the locking member 184 into the support member 151, or vice versa. The connector 182 is connected to the aperture 52 in the plate coupling 50, for example, a twist lock may twist within the aperture 52 in order to lock the connector 182 into the plate coupling 50. The connector drive 186 may be utilized to engage and disengage the connector 182 from the aperture 52 in the plate coupling 50 of the electrode adjustment device 10.

In some embodiments of the invention the support system 150 may further comprise one or more lower support members 160 utilized to support the electrode adjustment device 10 (e.g., the adjustment base 20 of the electrode adjustment device 10, or the like). In some embodiments of the positioning system 110, the lower support member 160 may not be used, and instead is only used to allow the vehicle positioning system 100 to have duel functionality for both disassembling and/or assembling the electrode through the use of the electrode adjustment device 10, and as a steel coil transport. The duel functionality may allow for more efficient use of the vehicle position system 100. Therefore, in some embodiments of the invention the one or more lower support members 160 may be a part of the support system 150, or it may be independent of the support system 150, and thus, operatively coupled to the lift system 140 directly. Moreover, it should be understood that in some embodiments the support system 150 may be removeably operatively coupled to the lift system 140 to allow for changing the vehicle positioning system 100 between the operations of positioning the electrode adjustment device 10 and transporting coils.

In some embodiments of the invention the one or more lower support members 160 may comprise a lower support pin 162. The lower support pin 162 may be an elongated member that may extend away from the lift system 140. In some embodiments of the invention the lower support pin 162 may be located generally transverse to the lift frame (e.g., the stationary lift frame 142 and/or the moveable lift frame 144), for example between 70 to 110 degrees, or the like. In other embodiments of the invention, the lower support pin 162 may be configured in other orientations. The lower support pin 162 may be operatively coupled to the lower coupling 19 of the electrode adjustment device 10, such as the adjustment base aperture 22 in the adjustment base 20.

Figure 17:
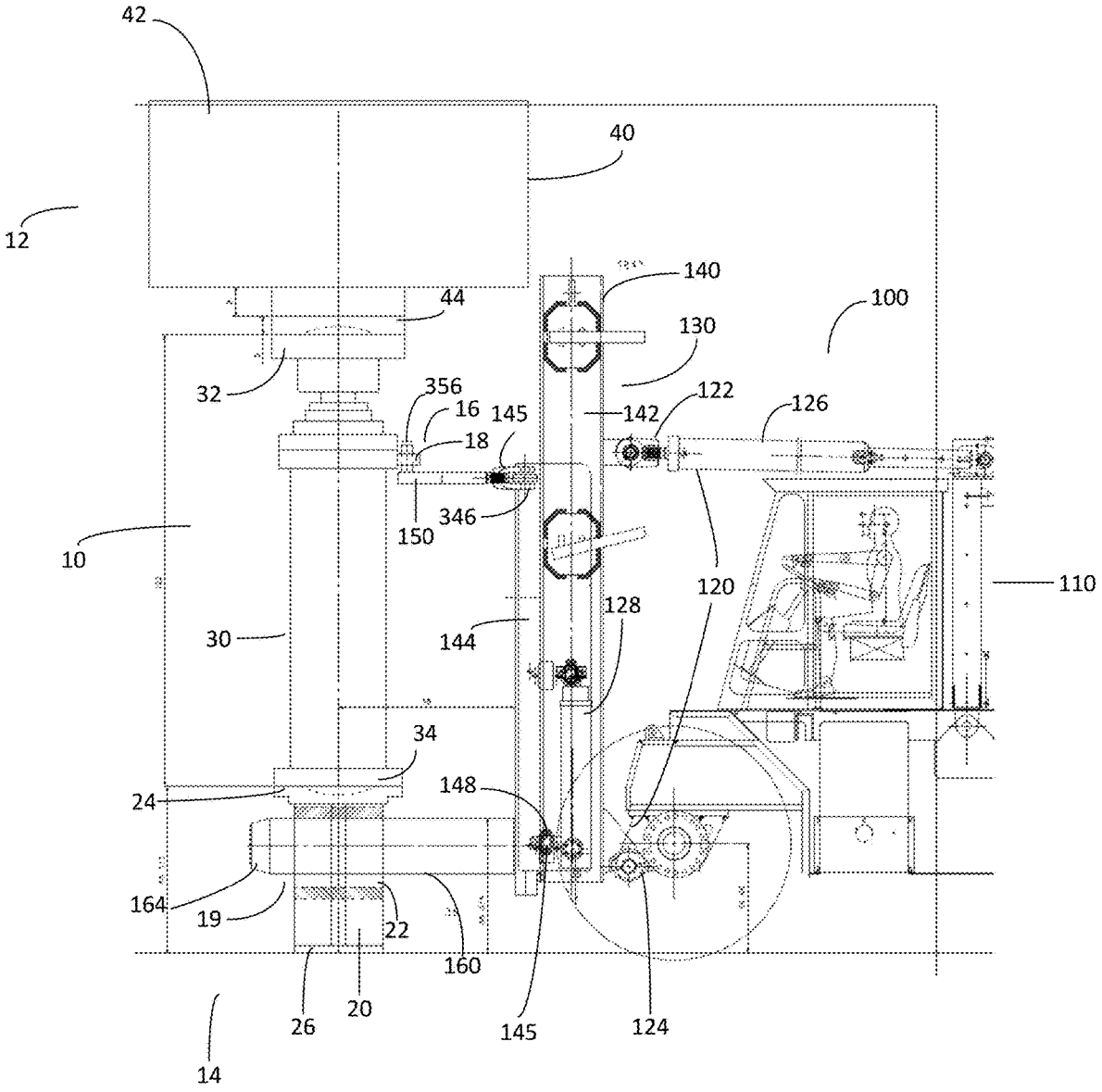
FIG. 17 illustrates a side view of the electrode adjustment device and the vehicle positioning system, in accordance with embodiments of the invention.
Figure 18:
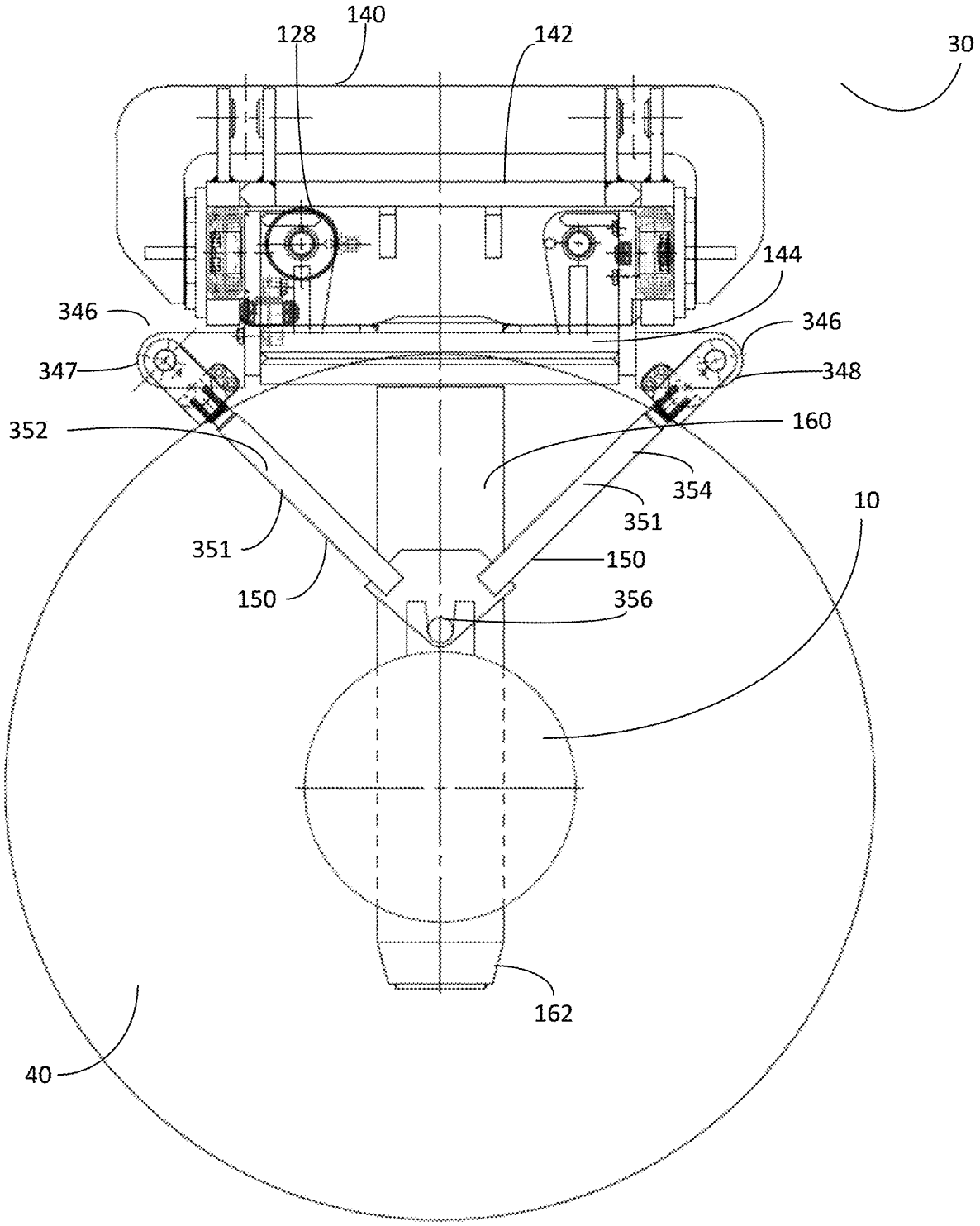
FIG. 18 illustrates a top view of the electrode adjustment device and the vehicle positioning system, in accordance with embodiments of the invention.

FIGS. 17 and 18 illustrate variations on the embodiments of the present invention. As illustrated in FIGS. 17 and 18 the one or more lift couplings 145 may comprise one or more upper lift couplings 346, which may include a first upper lift coupling 347 and a second upper lift coupling 348. Moreover, the support system 150 may comprise one or more upper support members 351, such as a first upper support member 352 and a second upper support member 354, or the like), which are utilized to support the electrode adjustment device 10. As such, the first upper lift coupling 347 may be operatively coupled to the first upper support member 352 (e.g., at a first member end), and the second upper lift coupling 348 may be operatively coupled to the second upper support member 354 (e.g., at a first member end). The first upper support member 352 and the second upper support member 354 may be operatively coupled to each other (e.g., at second member ends) and/or to an upper support pin 356, which may be operatively coupled to the electrode adjustment device 10. The upper support pin 356, in some embodiments of the invention may be located adjacent the second ends of the one or more upper support members 351 (e.g., near or at the second member ends). The upper support pin 356 may be located generally transverse to the one or more upper support members 351 (e.g., between 70 to 110 degrees, or the like). In other embodiments of the invention, the upper support pin 356 may be configured in other orientations. The upper support pin 356 may be operatively coupled to the upper coupling 18 of the electrode adjustment device 10, such as the upper aperture 52 in the upper tab 50. As previously discussed, the one or more lower support members 160 may comprise a lower support pin 162 that is also used to couple the vehicle positioning system 100 to the electrode removal device 10.

It should be understood that the upper support pin 356 and the lower support pin 162 may have bevels, and as such the distal ends of the pins 356, 162 may be smaller than the proximate ends of the pins 356, 162 in order to help guide the pins 356, 162 into couplings (e.g., apertures 52, 22). It should be further understood that the pins 356, 162 may be any size, such that the upper support pin 356 may be smaller, larger, or the same size as the lower support pin 162. Moreover, the pins 356, 162 may be any shape, and as such may have a cross-sectional shape that is circular, oval, square, rectangular, triangular, pentagonal, hexagonal, heptagonal, octagonal, any polygonal shape, any non-uniform shape, or any other like shape. Moreover, the pins 356, 162 may have different cross-sectional sizes and shapes at different locations along the pins 156, 162.

It should be further understood that combinations of the support systems 150 described herein may be used with each other or may be used with other components of support systems not specifically described herein.

Regardless of how the positioning system 130 is operatively coupled to the electrode adjustment device 10, the positioning system 130 may be operatively coupled to the vehicle system 110 in a number of ways. In one example, as illustrated in FIGS. 17 and 18, the positioning system 130 is operatively coupled to the vehicle system 110 through one or more vehicle couplings 120. In some embodiments of the invention the one or more vehicle couplings 120 may include an upper vehicle coupling 122 and/or a lower vehicle coupling 124. The upper vehicle coupling 122 may be operatively coupled to a transverse drive 126. In some embodiments of the invention the lower vehicle coupling 124 may include a swivel joint, such as a pin coupling, or other like coupling. The transverse drive 126 may allow for rotation the positioning system 130, by extending or retracting the transverse drive 126, which may rotate the positioning system 130 around the lower vehicle coupling 124 (e.g., the pin coupling). However, it should be understood that other connection systems between the vehicle system 110 and the positioning system 130 may be utilized.

The electrode adjustment device 10 and the vehicle positioning system 100 provide improved functionally over typical apparatuses used to remove and/or replace electrodes. The typical apparatuses may include platforms, handles, ladders, rails, tie-in locations, and/or the like, which allow for positioning the apparatus under a furnace for electrode removal or replacement. In the typical process the apparatus is stored within the facility at a storage location, such that an overhead crane may be utilized to move the apparatus (e.g., apparatus including an actuator, or the like) to a location near the furnace. Typically, when the device is needed, a user climbs on the device (e.g., using one of the attached ladders) and hooks onto one of the tie-in locations on the device for safety. Thereafter, the user attaches chains (or the like) from an overhead crane to the apparatus. The overhead crane lifts the typical apparatus over the floor of the facility to a location adjacent the furnace. The overhead crane may place the apparatus on a ladle car, which is typically used to transport ladles of molten steel, and the ladle car moves the apparatus to a position under the furnace. The ladle car may move along a track to locate the apparatus in one direction, and hydraulic cylinders on the ladle car are used to move the apparatus in other directions in order to position the apparatus under the electrode. When in position, an actuator in the apparatus pushes the electrode to dislodge it from the furnace and to lift it until it can be removed from the furnace. When an electrode is being replaced, an overhead crane and/or the actuator in the apparatus are used to slowly lower the electrode into place. During removal and/or replacement of an electrode the apparatus becomes covered in debris (e.g., dust, and other byproducts) that falls from the furnace, and requires cleaning. After the electrode is removed and/or replaced, the apparatus is removed from under the furnace through the use of the ladle car. Thereafter, a user is again required to climb on the apparatus (e.g., using the attached ladders), tie-in for safety, and hook the overhead crane up to the apparatus. Once connected to the crane the apparatus is moved to another location in the facility, such as a cleaning station. After reaching the cleaning station, users climb on the apparatus covered in debris to remove the crane connections, and thereafter additional users climb on the apparatus to clean the system before it is utilized again. The apparatus is cleaned to allow for the proper coupling with the electrode during additional electrode removal/replacements, as wells as for improving safety for users climbing on the apparatus, preventing debris from the apparatus from reaching other parts of the facility, or the like. The typical apparatus cannot be cleaned under the furnace because of the size of the systems (e.g., platforms, support members, ladders, or the like), and the limited space under the furnace.

It should be further understood that the movement of the typical apparatuses are limited to the areas were the ladle cart and/or the overhead crane can reach. Additionally, moving the apparatuses requires time for users to climb on the apparatus for hooking and unhooking chains from the overhead crane. Moreover, because of the bulky size of typical apparatuses it may also be difficult and/or dangerous for a user to maneuver around the apparatus in an effort to help guide a replacement electrode into the apparatus during reassembly. Consequently, some apparatuses may present a safety issue if they are not properly used. As will be discussed in further detail, the electrode adjustment device 10 and the vehicle positioning system 100 are utilized to simplify and improve the electrode removal and/or replacement process. By using the vehicle positioning system 100 the size of the electrode adjustment device 10 may be reduced (e.g., not platforms, ladders, safety bars, or the like are needed), and the electrode adjustment device 10 may be more mobile.

Figure 13:
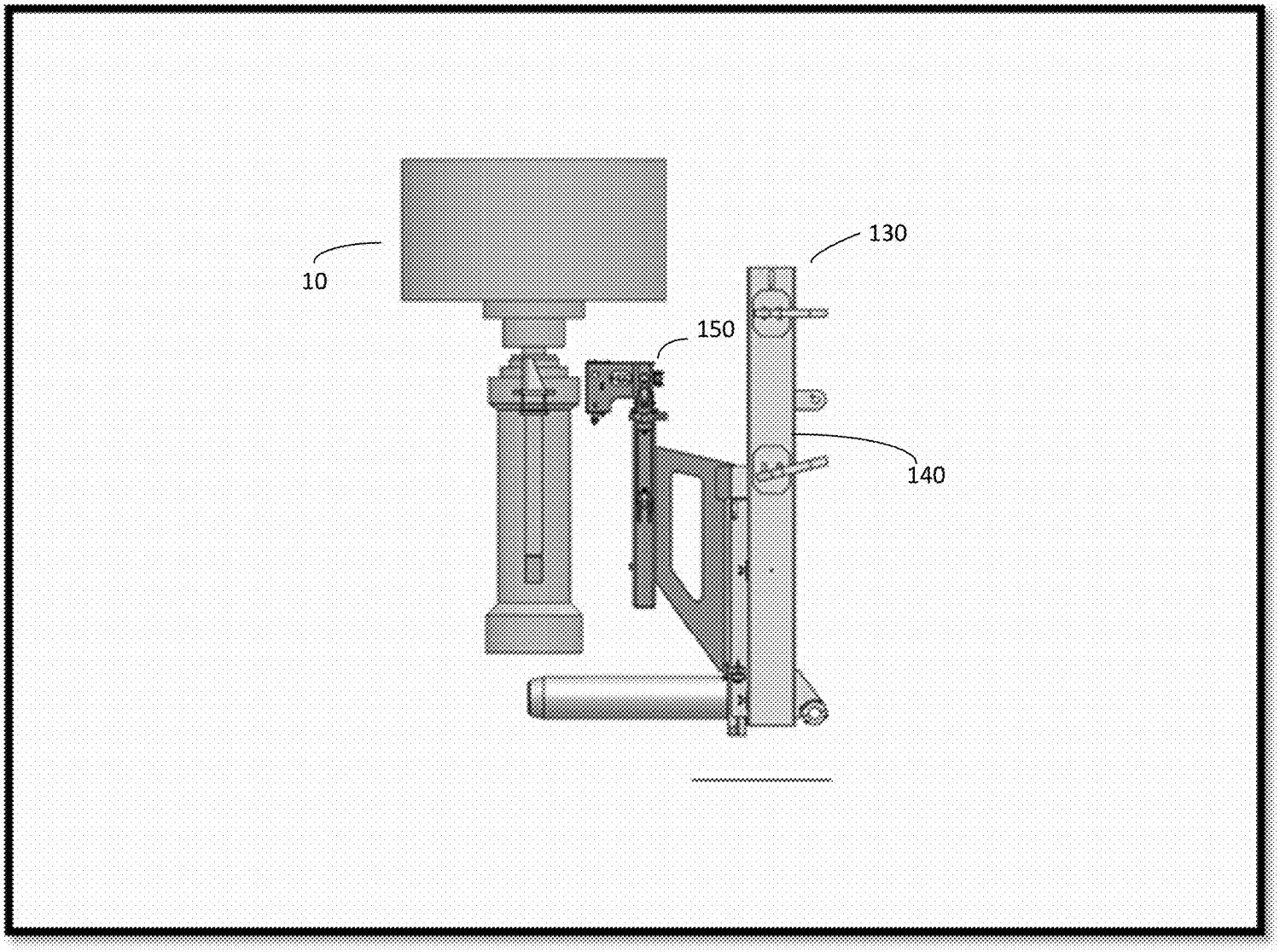
FIG. 13 illustrates a side view of the electrode adjustment device and positioning system in the lowered position, in accordance with embodiments of the invention.
Figure 14:
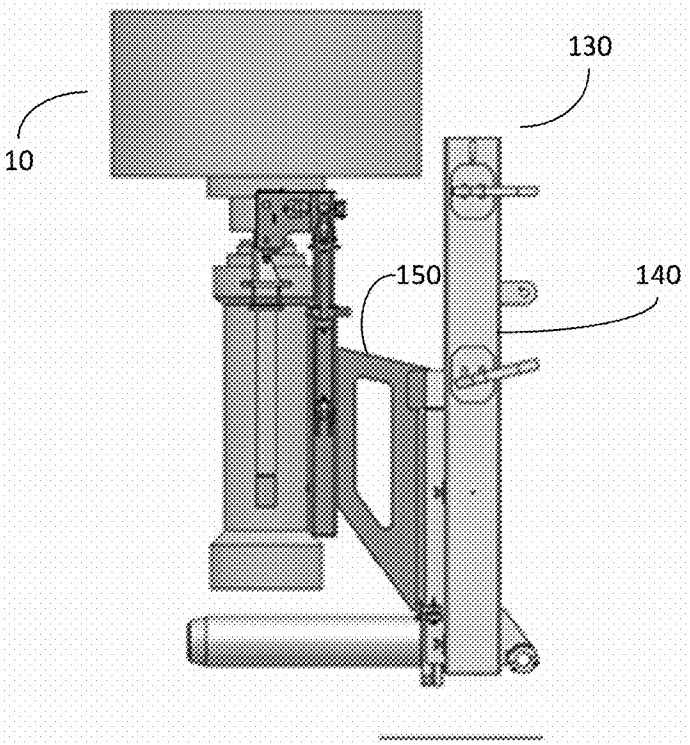
FIG. 14 illustrates a side view of the electrode adjustment device and positioning system in the raised position, in accordance with embodiments of the invention.
Figure 15:
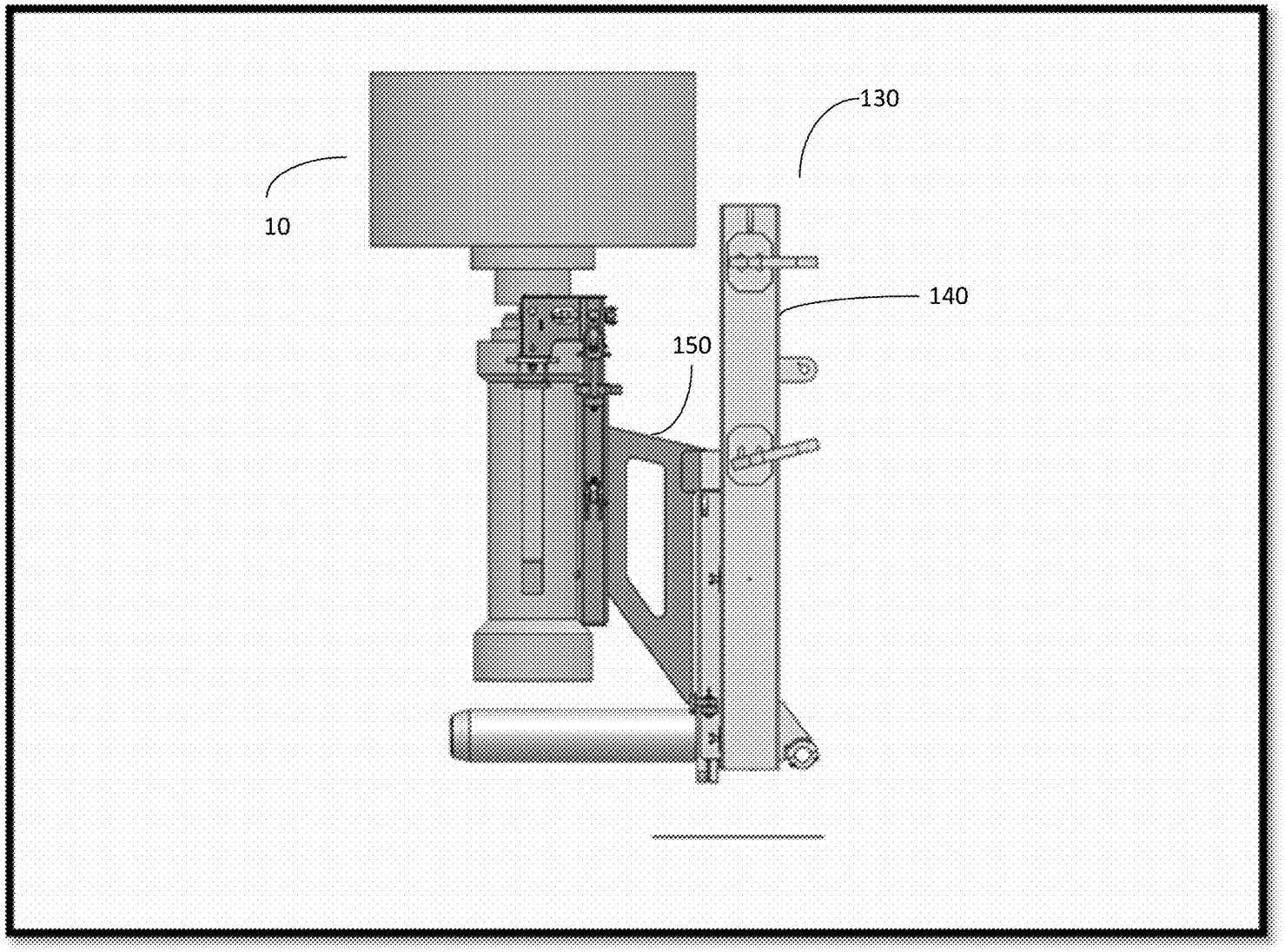
FIG. 15 illustrates a side view of the electrode adjustment device and positioning system in the locked position, in accordance with embodiments of the invention.
Figure 16:
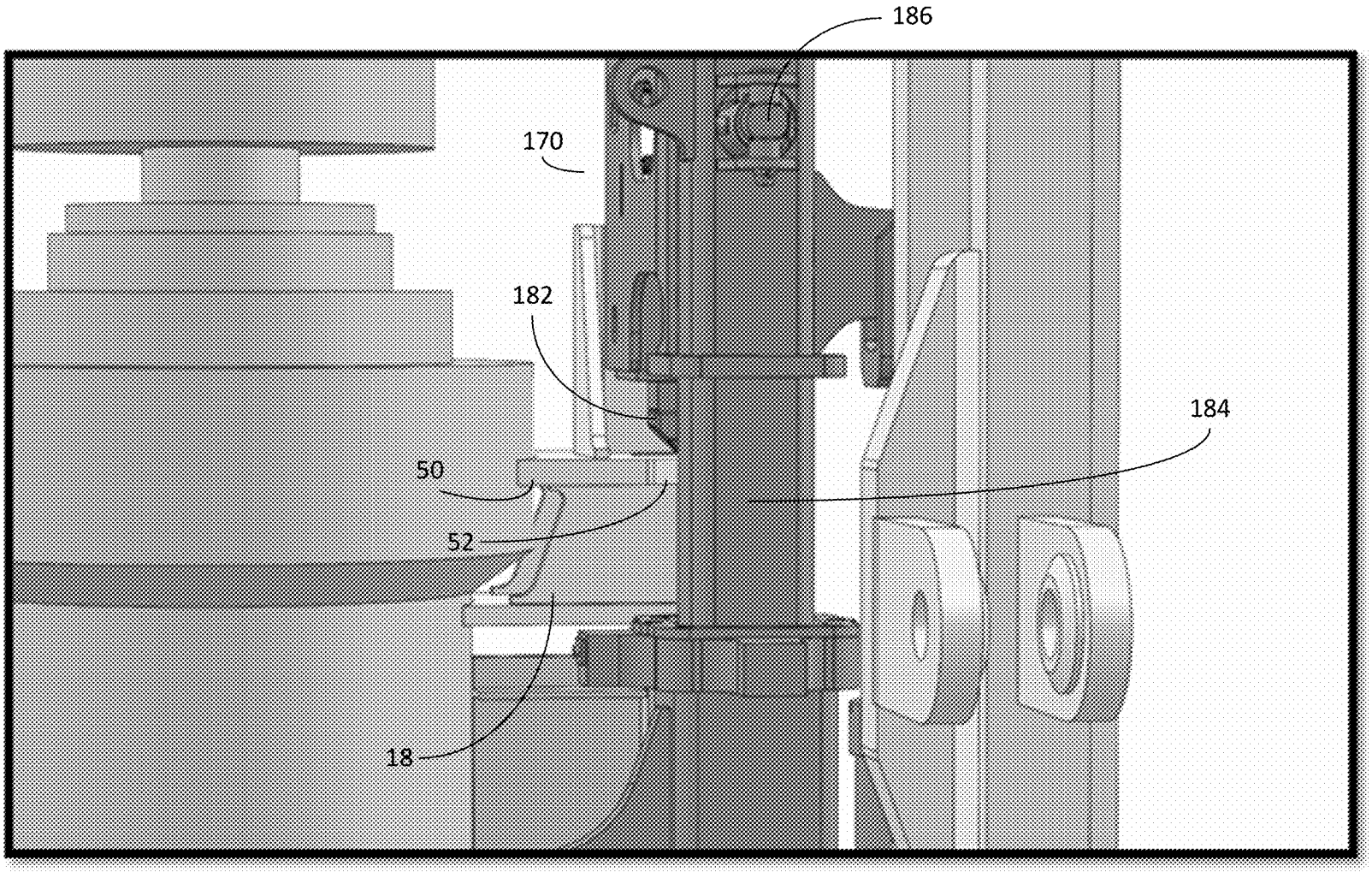
FIG. 16 illustrates a close up view of the electrode adjustment device and the locking system, in accordance with embodiments of the invention.
Figure 19:
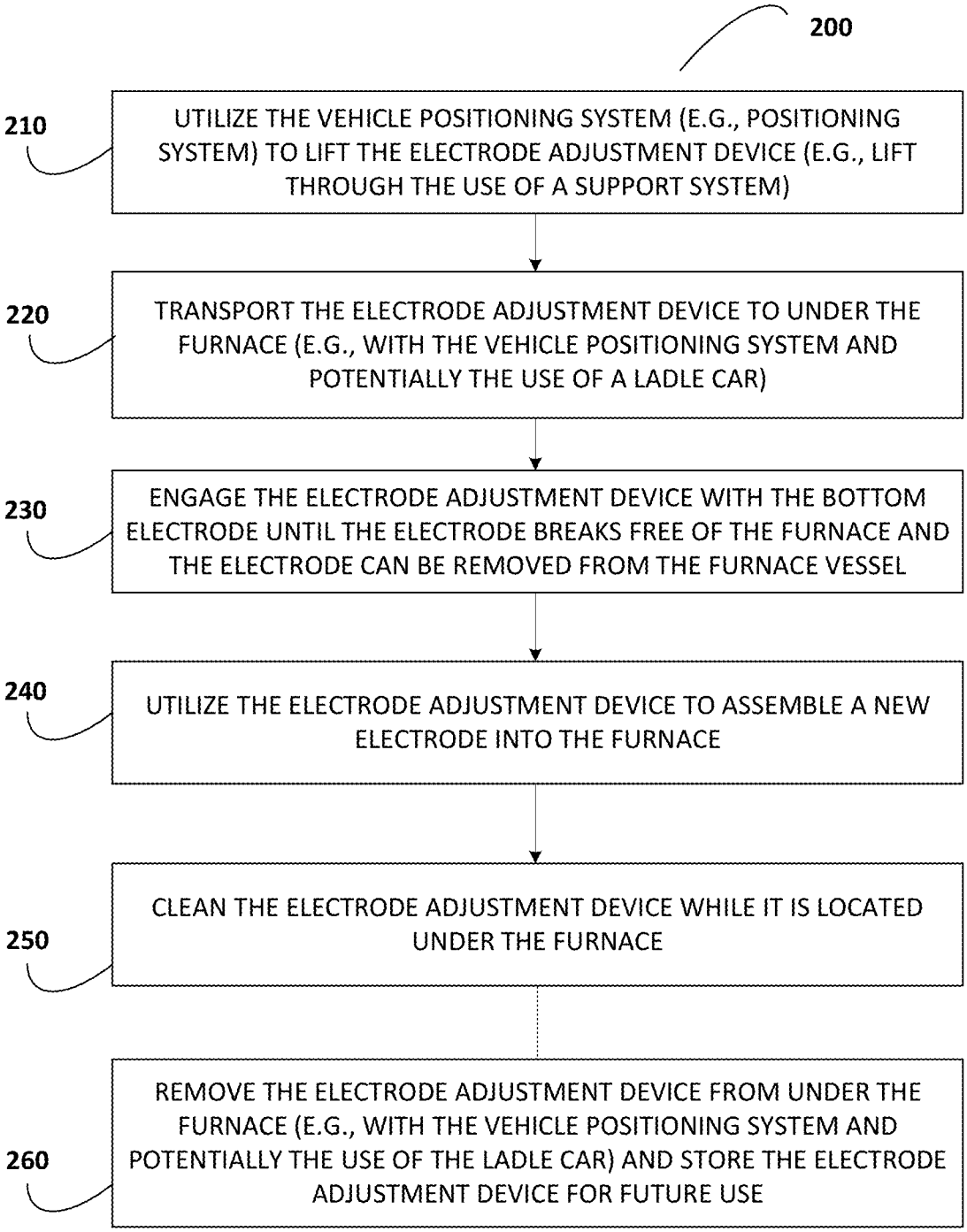
FIG. 19 illustrates a process flow for utilizing the electrode adjustment device and the vehicle positioning system, in accordance with embodiments of the invention.

FIG. 19 illustrates an improved process for removal and/or replacement of the electrode utilizing the electrode adjustment device 10 and the vehicle positioning system 100 described herein. As illustrated by block 210 in FIG. 19, the vehicle positioning system 100 may be utilized to lift the electrode adjustment device 10 from a stored position. Initially, the electrode adjustment device 10 may be located within a facility or outside of the facility in a horizontal position on the floor, in or on a support structure used to stand the device 10 vertically, or in or on a support structure used to store the device 10 in another way. The vehicle positioning system 100 may be used to lift the electrode adjustment device 10 by using the transverse drive 126 to rotate the positioning system 130 and/or the lift drive 128 to move the support system 150 (e.g., the locking system 170 and/or the one or more support members 351) into the desired position to operatively coupled (e.g., engage, or the like) the vehicle positioning system 100 to the electrode adjustment device 10. For example, the locking system 170 may be moved from a retracted position (e.g., the lower position as illustrated in FIG. 13) to an extended position (e.g., a raised position as illustrated in FIG. 14) in order to position the positioning system 130 for locking with the electrode adjustment device 10 (e.g., generally in the vertical direction). The locking system 170 may then be moved into position for securing with the electrode (e.g., through horizontal movement by moving the vehicle 111, an actuator such as a transverse drive 126, or moving the support system 150 or lift system 140). Thereafter, the locking system 170 may be moved to a locking position (e.g., a position between the raised and lower positions), and secured to the electrode adjustment couplings 16, such as the upper adjustment coupling 18 (e.g., through the connector 182 being engaged through the connector drive 186). In addition to the locking system 170, the lower support member 160 may be engaged with the electrode adjustment device 10. For example, a lower support pin 162 can be inserted into the respective aperture 22 on the electrode adjustment device 10, such as the adjustment base 20.

In another example, an upper support pin 356 is operatively coupled (e.g., engages) with the upper aperture 52 in the coupling plate 50 and the lower support pin 162 is operatively coupled (e.g., engages) with the adjustment base aperture 22. As such, the transverse drive 126 may be rotated such that the upper support pin 356 and the lower support pin 162 can be inserted into the respective apertures on the electrode adjustment device 10, and if necessary, thereafter rotated to a generally vertical angle (e.g., between 70 to 110 degrees from the horizontal orientation) in order to position the electrode adjustment device 10 for transport to the furnace.

Block 220 of FIG. 19 illustrates that the electrode adjustment device 10 is transported to a location adjacent (e.g., under or near) the furnace using the vehicle positioning system 100. In some embodiments of the invention, the positioning system 130 is maneuvered for transport by rotating the positioning system 130 (e.g., lift system 140) to a location that is generally vertical (e.g., between 70 to 110 degrees from the vertical position, or the like). Moreover the second lift frame 144 may be moved with respect to the first lift frame 142 to a position at which the support system 150 and/or the lower support member 160 positions the adjustment device second end 14 off of the foundation (e.g., ground, floor, or a support under the vehicle positioning system 100). The vehicle positioning system 100 may then move the electrode adjustment device 10 to a location adjacent the furnace. For example, the vehicle positioning system 100 may drive the electrode adjustment device 10 to a location under the furnace. In some instances the area under the furnace may be sized in such a way that the vehicle positioning system 100 may not be able to fit under the furnace. As such, in some instances of the invention the vehicle positioning system 100 may set the electrode adjustment device on the ladle cart, which can then be positioned under the furnace. When being positioned using the vehicle positioning system 100, the vehicle positioning system 100 may move the electrode adjustment device 10 by moving (e.g., forward, back, side to side, or rotating) the entire vehicle positioning system 100, and/or by adjusting (e.g., rotating, or the like) the positioning system 130 (e.g., the lift system 140) and/or moving the second lift frame 144 with respect to the first lift frame 142. Consequently, the electrode adjustment device 10 may be transported to different locations without the need to utilize an overhead crane, and in some case without the need to use the ladle cart. Moreover, due to the improved ability to control the horizontal, vertical, or spatial orientation of the electrode adjustment device 10, the electrode adjustment device 10 can more efficiently and precisely be located so that it appropriately operatively couples (e.g., engages) with the electrodes.

As illustrated by block 230 in FIG. 19, once in position adjacent the furnace (e.g., under the electrode in the furnace) the electrode adjustment device 10 may be engaged with the bottom electrode and provide enough upward force to break the electrode free of the furnace and push the electrode up into the furnace for removal from the furnace (e.g., through the use of an overhead crane to pull the electrode out of the furnace once it has been broken free from the furnace by the electrode adjustment device 10). In some embodiments of the invention, the electrode adjustment device 10 may push-up the electrode (e.g., the bottom electrode) through the use of the adjustment head 40 portion (e.g., a cylindrical metal portion), which is actuated by the adjustment drive 30 (e.g., a hydraulic cylinder). The adjustment drive 30 is typically configured to provide several tens, or hundreds, of tons of force to break the bottom electrode free of the hearth refractory and/or steelmaking by-products in the furnace, and thereafter, lift the bottom electrode to an elevation where it can be secured to an overhead crane and lifted out of the furnace.

Block 240 in FIG. 19 illustrates that the electrode adjustment device 10 may be located in place until a new electrode or a repaired electrode is assembled into the furnace. However, in other embodiments, the electrode adjustment device 10 may be removed before a new electrode is resembled into the furnace, as will be discussed with respect to blocks 250 and 260 below. If the electrode adjustment device 10 is retained in position, a new electrode (or repaired electrode) may be lowered into the furnace through the use of an overhead crane. In that event, the electrode is lowered into the furnace and through an aperture in the bottom of the furnace, and onto the electrode adjustment device 10, more specifically into or onto the adjustment head 40 of the electrode adjustment device 10. After the electrode is operatively coupled to the electrode adjustment device 10, the attachment of the electrode to the overhead crane may be removed. The adjustment drive 30, through the lowering of the adjustment head 40, and the vehicle positioning system 100, through the movement of the vehicle itself and/or the movement of the lift portion 130, are utilized to lower the electrode into the desired location within the furnace. Thereafter, the electrode adjustment device 10 holds the electrode in place and provides for fine adjustment of the electrode while the installation of the electrode is completed. It should be understood that because many of the components of typical apparatuses (e.g., the platforms, ladders, support frame, or the like) and the steps of typical methods are not present it is quicker, more efficient, cleaner, and safer to guide the electrode into the adjustment head 40 of the electrode adjustment device 10 and complete the electrode assembly when compared to typical apparatuses and methods.

Once the electrode is removed and/or replaced, as discussed above, the electrode adjustment device 10 may be cleaned in the location under the furnace (or adjacent the furnace, such as on the ladle cart), as illustrated by block 250 in FIG. 19. The electrode adjustment device 10 may become covered in debris (e.g., dirt, dust, solidified slag, solidified metal debris, other processing by-products, or the like) during removal and/or installation of an electrode. Since the area under the furnace may be cleaned anyway after removal and/or insertion of the electrode, and since the electrode adjustment device 10 is much smaller than typical apparatuses, the electrode adjustment device 10 and/or the vehicle positioning system 100 may also be cleaned under the furnace. For example, a user may use a water hose, or other cleaning system, to spray the electrode adjustment device 10 during or after the bottom electrode is removed or replaced. The user has improved access to the electrode adjustment device 10 for cleaning then the user would typically have with the bulky apparatuses that are currently used for electrode removal. By cleaning the electrode adjustment device 10 in place under the furnace, most of the debris from the cleaning falls to the ground under the furnace, where it can be cleaned later during preparation of the furnace for additional operation of the furnace.

As illustrated by block 260 of FIG. 19, the electrode adjustment device 10 is then removed from under the furnace through the use of the vehicle positioning system 100. If the vehicle positioning system 100 is not already operatively coupled (e.g., engaged, or the like) to the electrode adjustment device 10, a user may operatively couple (e.g., engage, or the like) the vehicle positioning system 100 with the electrode adjustment device 10, as has been previously discussed herein. Alternatively, when the electrode adjustment device 10 is positioned under the furnace using the ladle cart, the ladle cart is removed from under the furnace and the vehicle positioning system 100 is operatively coupled to the electrode adjustment device 10. After removal of the electrode adjustment device 10 from adjacent the furnace, the electrode adjustment device 10 may be transported to a location anywhere on the premises, opening up space near the furnace where the electrode adjustment device 10 would be stored based on typical methods (e.g., because of the limitations on where the overhead crane may reach).

It should be understood that the "couplings" described herein may be any type of couplings. As such, the couplings may be single couplings or combinations of couplings used to operatively couple components together. As such, the couplings may comprise, but are not limited to, apertures, pins, hooks, fasteners, screws, bolts, nuts, twist locks, cams, clamps, clips, flanges, slots, dovetails, shafts, collars, mounts, and/or any other like couplings not specifically described herein.

It should be understood that "operatively coupled," when used herein, means that the components may be formed integrally with each other, or may be formed separately and coupled together. Furthermore, "operatively coupled" means that the components may be formed directly to each other, or to each other with one or more components located between the components that are operatively coupled together. Furthermore, "operatively coupled" may mean that the components are detachable from each other, or that they are permanently coupled together.

Although specific terms are employed herein, they are used in a generic and descriptive sense only and not for purposes of limitation. In addition, where possible, any terms expressed in the singular form herein are meant to also include the plural form and/or vice versa, unless explicitly stated otherwise. Accordingly, the terms "a" and/or "an" shall mean "one or more."

Specific embodiments of the invention are described herein. Many modifications and other embodiments of the invention set forth herein will come to mind to one skilled in the art to which the invention pertains, having the benefit of the teachings presented in the foregoing descriptions and the associated drawings. Therefore, it is to be understood that the invention is not to be limited to the specific embodiments disclosed and that modifications and other embodiments and combinations of embodiments are intended to be included within the scope of the appended claims. As such, it will be understood that, where possible, any of the advantages, features, functions, devices, and/or operational aspects of any of the embodiments of the present invention described and/or contemplated herein may be included in any of the other embodiments of the present invention described and/or contemplated herein, and/or vice versa.

What is claimed is:

1. A vehicle positioning system, comprising:
a vehicle system comprising:
a vehicle; and
a transverse drive operatively coupled to the vehicle;
a positioning system operatively coupled to the vehicle of the vehicle system, through the transverse drive, wherein the positioning system comprises a lift system operatively coupled to a support system;
wherein the lift system comprises:
a lift frame having a first lift frame and a second lift frame, wherein the second lift frame is moveable with respect to the first lift frame;
a lift drive operatively coupled to the first lift frame or the second lift frame for moving the second lift frame with respect to the first lift frame; and
one or more lift couplings, wherein the one or more lift couplings are configured for operatively coupling with the support system;
wherein the support system comprises one or more support members that are configured for operatively coupling with one or more electrode adjustment device couplings of an electrode adjustment device;
wherein the lift drive and the transverse drive are configured for positioning the electrode adjustment device under a furnace for adjusting an electrode during removal or assembly with the furnace.

2. The vehicle positioning system of claim 1, further comprising:
the electrode adjustment device, comprising:
an adjustment drive;
an adjustment head operatively coupled to the adjustment drive;
an adjustment base operatively coupled to the adjustment drive; and
wherein the one or more electrode adjustment device couplings operatively coupled to the adjustment drive, the adjustment head, or the adjustment base.

3. The vehicle positioning system of claim 2, wherein a support member of the one or more support members is operatively coupled to the lift system;
wherein the adjustment base comprises an aperture;
wherein the support member is configured for entry and removal from the aperture of the adjustment base; and
wherein the support system is configured to be removable from the lift system in order to allow for transport of steel coils.

4. The vehicle positioning system of claim 1, wherein the support system comprises:
a support frame;
one or more locking systems, wherein the one or more locking systems are configured for operative coupling with the electrode adjustment device; and
one or more support couplings, wherein the one or more support couplings are configured for being operative coupling with the one or more lift couplings such that the support system may be removed and assembled.

5. The vehicle positioning system of claim 4, wherein the one or more support couplings comprise:
one or more upper support couplings;
one or more lower support couplings;
wherein the one more lift couplings comprise one or more upper lift couplings and one or more lower lift couplings;
wherein in the one or more upper support couplings are configured for operative coupling with the one or more upper lift couplings, and the one or more lower support couplings are configured for operative coupling with the one or more lower lift couplings.

6. The vehicle positioning system of claim 4, wherein the one or more locking systems comprises:
one or more locking couplings;
one or more locking drives;
wherein the electrode adjustment device comprises one or more electrode adjustment device couplings; and
wherein the one or more locking drives are configured for positioning the one or more locking couplings to assemble and disassemble the locking couplings with the one or more electrode adjustment device couplings to engage and disengage from the electrode adjustment device.

7. The vehicle positioning system of claim 3, wherein the one or more locking couplings comprise:
one or more connectors;
one or more connector drives operatively coupled to the one or more connectors;
wherein the one or more electrode adjustment device couplings comprise an aperture; and
wherein the one or more connectors are configured for operative coupling with the one or more electrode adjustment device couplings through inserting a portion of the one or more connectors through the aperture of the one or more electrode adjustment device couplings and locking the one or more connectors with the aperture to prevent removal from the aperture.

8. The vehicle positioning system of claim 1, wherein the one or more lift couplings comprise:
an upper lift coupling comprising at least a first upper lift coupling operatively coupled to the lift frame, and a second upper lift coupling operatively coupled to the lift frame; and
a lower lift coupling; and
wherein the one or more support members comprise:
a first upper support member operatively coupled to the first upper lift coupling;
a second upper support member operatively coupled to the second upper lift coupling; and
a lower support member operatively coupled to the lower lift couplings; and
wherein the first upper support member and the second upper support member are operatively coupled together and to the one or more electrode adjustment device couplings, and wherein the lower support member is configured for operative coupling with one of the one or more couplings of the electrode adjustment device.

9. The vehicle positioning system of claim 1, wherein the positioning system further comprises:
one or more vehicle couplings; and
wherein the vehicle is operatively coupled to the positioning system through the one or more vehicle couplings and the transverse drive.

10. The vehicle positioning system of claim 9, wherein the one or more vehicle couplings comprise:

at least one upper vehicle coupling operatively coupling the vehicle to the positioning system through the transverse drive;

a lower vehicle coupling operatively coupling the vehicle to the positioning system through a rotational connection; and wherein the transverse drive rotates the positioning system around the lower vehicle coupling.

11. An electrode adjustment device, comprising:

an adjustment drive;

an adjustment base operatively coupled to the adjustment drive;

an adjustment head operatively coupled to the adjustment drive;

one or more electrode adjustment device couplings operatively coupled to the adjustment drive, adjustment base, or the adjustment head;

wherein the one or more electrode adjustment device couplings are configured for operative coupling with a vehicle positioning system that is configured to lift the electrode adjustment device for positioning under a furnace to support a bottom of an electrode; and wherein the adjustment drive is configured to move the adjustment head and the adjustment base longitudinally towards and away from each other to aid in supporting the bottom of the electrode for removing the electrode from, or assembling the electrode to, the furnace.

12. The electrode adjustment device of claim 11, wherein the one of the one or more electrode adjustment device couplings comprise a lower electrode adjustment device coupling operatively coupled to the adjustment base; and wherein the lower electrode adjustment device coupling is an aperture in the adjustment base configured to receive a lower support member from the vehicle positioning system.

13. A method for removing an electrode within a furnace utilizing an electrode adjustment device and a vehicle positioning system, the method comprising:

utilizing the vehicle positioning system to operatively couple the vehicle positioning system with the electrode adjustment device;

wherein the vehicle positioning system comprises:

a vehicle system comprising;

a vehicle; and a transverse drive operatively coupled to the vehicle;

a positioning system operatively coupled to the vehicle of the vehicle system through the transverse drive, wherein the positioning system comprises:

a lift system; and a support system comprising one or more support couplings, wherein the support system is operatively coupled to the lift system; and wherein the lift system comprises a first lift frame and a second lift frame, wherein the second lift frame is moveable with respect to the first lift frame, and a lift drive operatively coupled to the first lift frame or the second lift frame for moving the second lift frame with respect to the first lift frame;

wherein the electrode adjustment device comprises:

an adjustment drive;

an adjustment base operatively coupled to the adjustment drive;

an adjustment head operatively coupled to the adjustment drive; and one or more electrode adjustment device couplings operatively coupled to the adjustment drive, the adjustment base, or the adjustment head; and wherein the one or more support couplings are operatively coupled to the one or more electrode adjustment device couplings;

wherein the adjustment drive is configured to move the adjustment head and the adjustment base longitudinally towards and away from each other to adjust the electrode using the adjustment head to aid in removing the electrode from, or assembling the electrode to, the furnace.

14. The method of claim 13, further comprising transporting the electrode adjustment device to adjacent the electrode in the furnace using the vehicle positioning system;

disengaging the vehicle positioning system from the electrode adjustment device; and adjusting the electrode in the furnace by separating the electrode from the furnace using the electrode adjustment device.

15. The method of claim 13, further comprising:

transporting the electrode adjustment device away from the furnace using the vehicle positioning system; and disengaging the vehicle positioning system from the electrode adjustment device.

16. The method of claim 13, wherein utilizing the vehicle positioning system to operatively couple the vehicle positioning system with the electrode adjustment device comprises:

extending a locking system to a raised position;

moving the locking system for coupling with one or more electrode adjustment couplings of the electrode adjustment device, wherein the locking system is moved by moving at least a portion of the positioning system or by moving the vehicle positioning system; and retracting the locking system to a locked position.

17. The method of claim 13, wherein the one of the one or more electrode adjustment device couplings comprise a lower adjustment device coupling within the adjustment base;

wherein the lower adjustment device is configured to receive a lower support member of the positioning system.

18. The method of claim 13, wherein the vehicle positioning system further comprises:

one or more vehicle couplings operatively coupling the positioning system to the transverse drive, wherein the one or more vehicle couplings comprise:

an upper vehicle coupling operatively coupling the vehicle to the positioning system through the transverse drive; and a lower vehicle coupling operatively coupling the vehicle to the positioning system through a rotational connection; and wherein the transverse drive rotates the positioning system around the lower vehicle coupling.

* * * * *